US012446700B2

(12) United States Patent
Porter et al.

(10) Patent No.: US 12,446,700 B2
(45) Date of Patent: Oct. 21, 2025

(54) FURNITURE OBJECTS FOR STORING FOLDABLE BEDS

(71) Applicant: Night and Day Furniture LLC, Vancouver, WA (US)

(72) Inventors: Howard Porter, Kuala Lumpur (MY); Joel Grossman, Petaling Jaya (MY)

(73) Assignee: Night and Day Furniture LLC, Vancouver, WA (US)

( * ) Notice: Subject to any disclaimer, the term of this patent is extended or adjusted under 35 U.S.C. 154(b) by 716 days.

(21) Appl. No.: 17/747,336

(22) Filed: May 18, 2022

(65) Prior Publication Data

US 2022/0273107 A1 Sep. 1, 2022

Related U.S. Application Data

(63) Continuation-in-part of application No. 17/145,660, filed on Jan. 11, 2021, now abandoned, which is a (Continued)

(51) Int. Cl.

| | |
|---|---|
| ***A47C 17/48*** | (2006.01) |
| ***A47C 17/58*** | (2006.01) |
| ***A47C 19/12*** | (2006.01) |

(52) U.S. Cl.

CPC ..... *A47C 17/58* (2013.01); *A47C 19/12* (2013.01)

(58) Field of Classification Search

CPC ..... A47C 19/12; A47C 17/48; A47C 17/52; A47C 17/58

See application file for complete search history.

(56) References Cited

U.S. PATENT DOCUMENTS

| | | | |
|---|---|---|---|
| 93,556 | A | 8/1869 | Robinson |
| 157,719 | A | 12/1874 | Iverson |

(Continued)

FOREIGN PATENT DOCUMENTS

| | | | |
|---|---|---|---|
| CA | 2857823 | A1 | 1/2016 |
| CN | 2757674 | Y | 2/2006 |

(Continued)

OTHER PUBLICATIONS

Non-Final Office Action in U.S. Appl. No. 17/145,660 dated Sep. 7, 2022.

(Continued)

*Primary Examiner* — Justin C Mikowski
*Assistant Examiner* — Ifeolu A Adeboyejo
(74) *Attorney, Agent, or Firm* — Harness, Dickey & Pierce, P.L.C.

(57) ABSTRACT

A chest including a front panel, side panels and a top panel, the top panel including a first sub-top panel and a second sub-top panel hingably connected, a first portion of the front panel being hingably connected to a base of the chest, and a second portion of the front panel hingably connected to the first portion of the front panel and fixed to first sub-side panels, wherein the second portion of the front panel is stored when the chest is in an closed position, the first portion and the second portion of the front panel form a portion of a sleeping platform when the chest is in an open position, and the first sub-top panel is foldable onto the second sub-top panel to reduce a width the top panel extends at least during a transition between the open position and the closed position.

20 Claims, 25 Drawing Sheets

Related U.S. Application Data continuation of application No. 16/519,687, filed on Jul. 23, 2019, now Pat. No. 10,888,170, which is a continuation-in-part of application No. 16/429,477, filed on Jun. 3, 2019, now abandoned, which is a continuation of application No. 15/983,347, filed on May 18, 2018, now Pat. No. 10,349,750, which is a continuation of application No. 14/809,736, filed on Jul. 27, 2015, now Pat. No. 9,993,088, said application No. 16/519,687 is a continuation-in-part of application No. 15/828,913, filed on Dec. 1, 2017, now Pat. No. 11,324,327.

(60) Provisional application No. 61/999,876, filed on Aug. 8, 2014.

(56) References Cited

U.S. PATENT DOCUMENTS

| | | | | |
|---|---|---|---|---|
| 179,013 | A | 6/1876 | Green | |
| 189,303 | A | 4/1877 | Crosby | |
| 192,621 | A | 7/1877 | Green | |
| 201,282 | A | 3/1878 | Ogbom | |
| 215,134 | A | 5/1879 | Kiss | |
| 218,678 | A | 8/1879 | Koskul | |
| 225,393 | A | 3/1880 | Kendrick | |
| 239,805 | A | 4/1881 | Knapp | |
| 268,307 | A | 11/1882 | Stanton | |
| 319,083 | A | 6/1885 | Farrar | |
| 327,076 | A | 9/1885 | Farrar | |
| 348,643 | A | 9/1886 | Strahan | |
| 354,729 | A | 12/1886 | Montgomery | |
| 379,449 | A | 3/1888 | Condell | |
| 394,688 | A | 12/1888 | Green | |
| 445,777 | A | 2/1891 | Goodwillie | |
| 474,587 | A | 5/1892 | Yeager | |
| 538,470 | A | 4/1895 | Lungstras | |
| 565,496 | A | 8/1896 | Robinson | |
| 716,026 | A | 12/1902 | Geisel | |
| 791,857 | A | 6/1905 | Arnold | |
| 1,170,149 | A * | 2/1916 | Gustafson | A47C 17/48 5/503.1 |
| 1,359,337 | A | 11/1920 | Culbertson | |
| 1,366,368 | A | 1/1921 | Draper | |
| 1,375,524 | A | 4/1921 | McGhee | |
| 1,757,068 | A | 5/1930 | Wikman | |
| D110,907 | S | 8/1938 | Patz | |
| 2,356,321 | A | 8/1944 | Irick | |
| D158,038 | S | 4/1950 | Barmache | |
| 2,544,762 | A | 3/1951 | Lochridge | |
| 2,566,256 | A | 8/1951 | Snyder | |
| 2,577,741 | A | 12/1951 | Creveling | |
| D165,746 | S | 1/1952 | Gaines | |
| 2,788,528 | A * | 4/1957 | Hansen | A47C 17/62 5/179 |
| 3,537,769 | A | 11/1970 | Di Constantino | |
| 3,540,788 | A * | 11/1970 | Lundquist | A47B 29/00 312/237 |
| 3,638,249 | A | 2/1972 | Katsigarakis | |
| 3,755,832 | A | 9/1973 | Bennett | |
| D228,990 | S | 11/1973 | Villanova | |
| 3,858,253 | A | 1/1975 | Lauzon | |
| 4,070,715 | A | 1/1978 | Reppas | |
| 4,263,854 | A | 4/1981 | Moore et al. | |
| 4,277,856 | A | 7/1981 | Danin | |
| 4,318,195 | A | 3/1982 | Reppas | |
| D276,386 | S | 11/1984 | Shaw | |
| D279,339 | S | 6/1985 | Testa | |
| 4,793,011 | A | 12/1988 | Eve | |
| 4,999,865 | A * | 3/1991 | Sauder | A47C 17/58 5/56 |
| 5,101,523 | A | 4/1992 | Bright | |
| 5,353,452 | A | 10/1994 | Rulis | |
| 5,440,768 | A | 8/1995 | Danin | |
| 5,522,102 | A | 6/1996 | Vayda | |
| 5,652,978 | A | 8/1997 | Wiig | |
| 5,794,283 | A | 8/1998 | Vila et al. | |
| 5,806,248 | A | 9/1998 | Kim | |
| 5,913,769 | A | 6/1999 | Byma et al. | |
| 6,088,849 | A | 7/2000 | Lieber | |
| 6,463,603 | B1 | 10/2002 | Camfield | |
| 6,851,139 | B2 | 2/2005 | Arason et al. | |
| 7,013,506 | B2 | 3/2006 | Revels | |
| 7,017,201 | B2 | 3/2006 | Lin | |
| 7,140,052 | B2 | 11/2006 | Monestier et al. | |
| 7,231,675 | B1 | 6/2007 | Rucinski | |
| D583,586 | S | 12/2008 | Gudenkauf | |
| 7,574,758 | B2 | 8/2009 | Arason et al. | |
| 8,006,327 | B1 | 8/2011 | Burchett | |
| D663,141 | S | 7/2012 | Ardis et al. | |
| D669,706 | S | 10/2012 | Zambelli | |
| 8,407,830 | B1 | 4/2013 | Kumar | |
| 8,572,776 | B2 | 11/2013 | Grubb | |
| D712,676 | S | 9/2014 | Flora | |
| D714,087 | S | 9/2014 | Youngstrom | |
| 8,833,518 | B2 | 9/2014 | Holcombe | |
| D742,136 | S | 11/2015 | Flora | |
| 9,468,305 | B2 | 10/2016 | Flora | |
| 9,549,618 | B1 | 1/2017 | Honarvar | |
| D793,127 | S | 8/2017 | Zhuravlev | |
| D817,666 | S | 5/2018 | Davis et al. | |
| 10,349,750 | B2 | 7/2019 | Porter | |
| D910,341 | S | 2/2021 | Ye | |
| D963,381 | S | 9/2022 | Davis et al. | |
| D1,006,476 | S | 12/2023 | Byrne | |
| D1,014,144 | S | 2/2024 | Zheng | |
| D1,022,538 | S | 4/2024 | Bergmann et al. | |
| D1,024,625 | S | 4/2024 | Song | |
| D1,047,492 | S | 10/2024 | Ju | |
| D1,058,248 | S | 1/2025 | Mao | |
| D1,059,087 | S | 1/2025 | Yang | |
| 2004/0093669 | A1 * | 5/2004 | Arason | A47C 19/122 5/160 |
| 2006/0031986 | A1 | 2/2006 | Revels | |
| 2006/0225210 | A1 | 10/2006 | Arason et al. | |
| 2008/0016617 | A1 | 1/2008 | Plantefever et al. | |
| 2008/0264723 | A1 | 10/2008 | Tatum | |
| 2011/0304251 | A1 | 12/2011 | Bernett et al. | |
| 2014/0047638 | A1 | 2/2014 | Zimmer | |
| 2016/0022048 | A1 | 1/2016 | Flora | |
| 2016/0037934 | A1 | 2/2016 | Porter | |
| 2016/0242556 | A1 | 8/2016 | Ray | |
| 2019/0167008 | A1 | 6/2019 | Grossman et al. | |
| 2019/0191889 | A1 * | 6/2019 | Flora | A47C 19/22 |
| 2021/0037983 | A1 | 2/2021 | Marjadsingh | |
| 2024/0008648 | A1 | 1/2024 | Sullivan et al. | |
| 2025/0031860 | A1 | 1/2025 | Grossman et al. | |

FOREIGN PATENT DOCUMENTS

| | | | |
|---|---|---|---|
| CN | 201557794 | U | 8/2010 |
| CN | 304148658 | | 8/2016 |
| CN | 307374430 | | 3/2022 |
| FR | 536132 | A | 4/1922 |
| FR | 953688 | A | 12/1949 |
| FR | 1084476 | A | 1/1955 |
| FR | 1589047 | A | 3/1970 |
| KR | 101601937 | B1 | 3/2016 |
| TH | 2002005695 | | 12/2020 |

OTHER PUBLICATIONS

Antique Victorian Hand Carved wood Fold-up Murphy Bed Chest Dresser, sold on ebay on Feb. 26, 2016, retrieved on Feb. 4, 2019, (https://www.ebay.com/itm/Antique-Victorian-Hand-Carved-wood-Fold-up-Murphy-Bed-Chest-Dresser-/281922985462?hash=item41a3eb5df6:g:ZhIAAOSwZd1Vb2Oa).

Vintage Murphy bed, circa 1920s, Etsy photos, retrieved on Feb. 4, 2019, Sold on Dec. 22, 2018, (https://www.etsy.com/listing/630652228/vintage-murphybed?gpla=1&gao=1&&utm_source=google&utm_medium=cpc&utm_campaign=shopping_us_a-home_and_living-

(56) References Cited

OTHER PUBLICATIONS furniturebedroom_furniture-beds_and_headboards&utm_custom1=2e81fb16-fb6f-4098-96dc-34642e4931ca&utm_content=go_270948755_43325476758_194213642053_aud-301856855998:pla-308550201595_c_630652228&gclid=EAlalQobChMlubn6jcKL3wIVEZ7ACh3nzArREAKYliABEgLG6_D_BwE).
Invalidity Contentions of Defendant Atlantic Furniture, Inc. filed Dec. 19, 2018 in the United States District Court for the District of Massachusetts in Civil Action No. 3:18-CV-30104-KAR.
Office Action dated Jan. 28, 2019 by the Canadian Intellectual Property Office for CA Application No. 2,990,536.
Non-Final Office Action issued on Oct. 7, 2019 for U.S. Appl. No. 16/429,477.
Night and Day Furniture, "Siesta Desk Bed", video dated Jan. 27, 2023 https://www.youtube.com/watch?v=zdYmj5I7REA (Year: 2023).
Michael Hilgers, "Folding Desk Hybrid", video dated Sep. 22, 2021 https://www.youtube.com/watch?v=7gt9QEOP3D8 (Year: 2021).
Rockier Woodworking, "Desk to bed hardware", video dated Jan. 15, 2014 https://www.youtube.com/watch?v=bdZ_ZSfEQIk (Year: 2014).

* cited by examiner

FURNITURE OBJECTS FOR STORING FOLDABLE BEDS

RELATED APPLICATIONS

This application is a continuation-in-part of U.S. application Ser. No. 17/145,660, filed on Jan. 11, 2021, which is a continuation application of U.S. application Ser. No. 16/519,687, filed on Jul. 23, 2019, which is a continuation-in-part of U.S. application Ser. No. 15/828,913, filed on Dec. 1, 2017 and a continuation-in-part of U.S. application Ser. No. 16/429,477, filed on Jun. 3, 2019, which is a continuation application of U.S. application Ser. No. 15/983,347, filed on May 18, 2018, which is a continuation application of U.S. application Ser. No. 14/809,736, filed on Jul. 27, 2015, which claims priority under 35 U.S.C. § 119 to U.S. Provisional Application No. 61/999,876 filed on Aug. 8, 2014, the entire contents of each of which are hereby incorporated by reference in their entirety.

FIELD

The present disclosure relates generally to furniture objects configured to store foldable beds.

BACKGROUND

The statements in this section merely provide background information related to the present disclosure and may not constitute prior art.

Often, furniture apparatuses capable of more than one function are used in environments (e.g., residential, commercial, etc.) where space is limited. For example, futon beds or other like foldable beds may be used in such environments as sitting furniture (e.g., couches, sofas, etc.) and lying and/or sleeping furniture (e.g., beds, etc.). In these environments, futon beds may make more efficient use of the limited space and may relieve the need for additional furniture. However, even futon beds may take up too much space in certain environments.

SUMMARY

Some example embodiments relate to a chest configured to transition between an open position and a closed position.

In some example embodiments, the chest includes a front panel, side panels and a top panel, the front panel including a first portion and a second portion, the side panels including first sub-side panels and second sub-side panels, the first portion of the front panel being hingably connected to a base of the chest, and the second portion of the front panel hingably connected to the first portion of the front panel and fixed to the first sub-side panels, wherein the second portion of the front panel is stored within an enclosure formed by at least the first portion of the front panel, the side panels and the top panel when the chest is in the closed position, and the first portion and the second portion of the front panel form at least a portion of a sleeping platform when the chest is in the open position.

In some example embodiments, the chest further includes blocks configured to maintain a gap between the first portion of the front panel and a ground during at least a portion of a transition of the chest from the closed position to the open position.

In some example embodiments, the blocks are pivotably attached to the chest, the blocks configured to pivot outwards beyond an outer surface of the first portion of the front panel during the transition of the chest from the closed position to the open position.

In some example embodiments, the blocks are pivotably attached to the first portion of the front panel such that the blocks are configured to support at least the first portion of the front panel during a period of the transition of the chest from the closed position to the open position.

In some example embodiments, the first sub-side panels each include legs connected thereto, the legs including front legs and rear legs.

In some example embodiments, the rear legs include rollers attached to a bottom surface thereof, the rollers configured to allow the rear legs to move in a first direction when a connection point between the first portion and the second portion moves in a second direction, the second direction being substantially perpendicular to the first direction.

In some example embodiments, the second portion of the front panel is configured to form a lever to assist in transitioning the chest between the closed position and the open position.

In some example embodiments, rear legs attached to the first sub-side panels act as a fulcrum of the lever.

In some example embodiments, the chest further includes a rear foldable leg assembly connected to the first sub-side panels, the rear foldable leg assembly configured to transition from a folded state to an unfolded state such that, in the unfolded state, the rear foldable leg assembly is configured to support at least a lower portion of the sleeping platform.

In some example embodiments, the rear foldable leg assembly includes a pair of rear legs such that, in the unfolded state, the pair of rear legs are directly under a hinge connecting the second portion of the front panel to the first portion of the front panel.

In some example embodiments, the chest further includes a folding deck within the enclosure, the folding deck configured to transition between an unfolded state and a folded state such that the folding deck separates the enclosure into a top portion and bottom portion when the folding deck is in the unfolded state, and combines the top portion and the bottom portion of the enclosure into a single usable space when the folding deck is in the folded state.

In some example embodiments, the second portion and the first portion of the front panel form a lower portion and a middle portion of the sleeping platform, respectively, when the chest is in the open position, and the folding deck forms an upper portion of the sleeping platform when the folding deck is in the unfolded state.

In some example embodiments, the chest is configured to, store a foldable mattress in the single usable space when the folding deck is in the folded state, and receive the foldable mattress on the sleeping platform when the chest is in the open position and the folding deck is in the unfolded state.

In some example embodiments, when the chest is in the closed position, an outer surface of the first portion of the front panel is visible, and when the chest is in the open position, the sleeping platform is configured to support the foldable mattress such that the foldable mattress rests on the folding deck, an inner surface of the first portion of the front panel and the second portion of the front panel, the inner surface of the first portion of the front panel being opposite the outer surface.

In some example embodiments, the top panel includes a first sub-top panel and a second sub-top panel, the second sub-top panel and the second sub-side panels forming at least part of the base of the chest.

In some example embodiments, the first sub-side panels are configured to abut respective ones of the second sub-side panels to form the side panels when the chest is in the closed position, and the first sub-top panel is configured to abut the second sub-top panel to form the top panel when the chest is in the closed position.

In some example embodiments, while the chest is transitioning from the closed position to the open position, the first sub-side panels are configured to move relative to the base of the chest while the second sub-side panels remain stationary.

In some example embodiments, the chest further includes a back panel fixed to the second sub-side panels, the back panel configured as a headboard when the chest is in the open position.

In some example embodiments, the chest further includes a strap attached to the second portion of the front panel, the strap configured to transfer a force exerted by a user thereon to the second portion of the front panel to unfold the second portion of the front panel from on top of the first portion of the front panel while the chest is transitioning to the open position and to fold the second portion of the front panel on top of the first portion of the front panel while the chest is transitioning to the closed position.

Further areas of applicability will become apparent from the description and figures provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
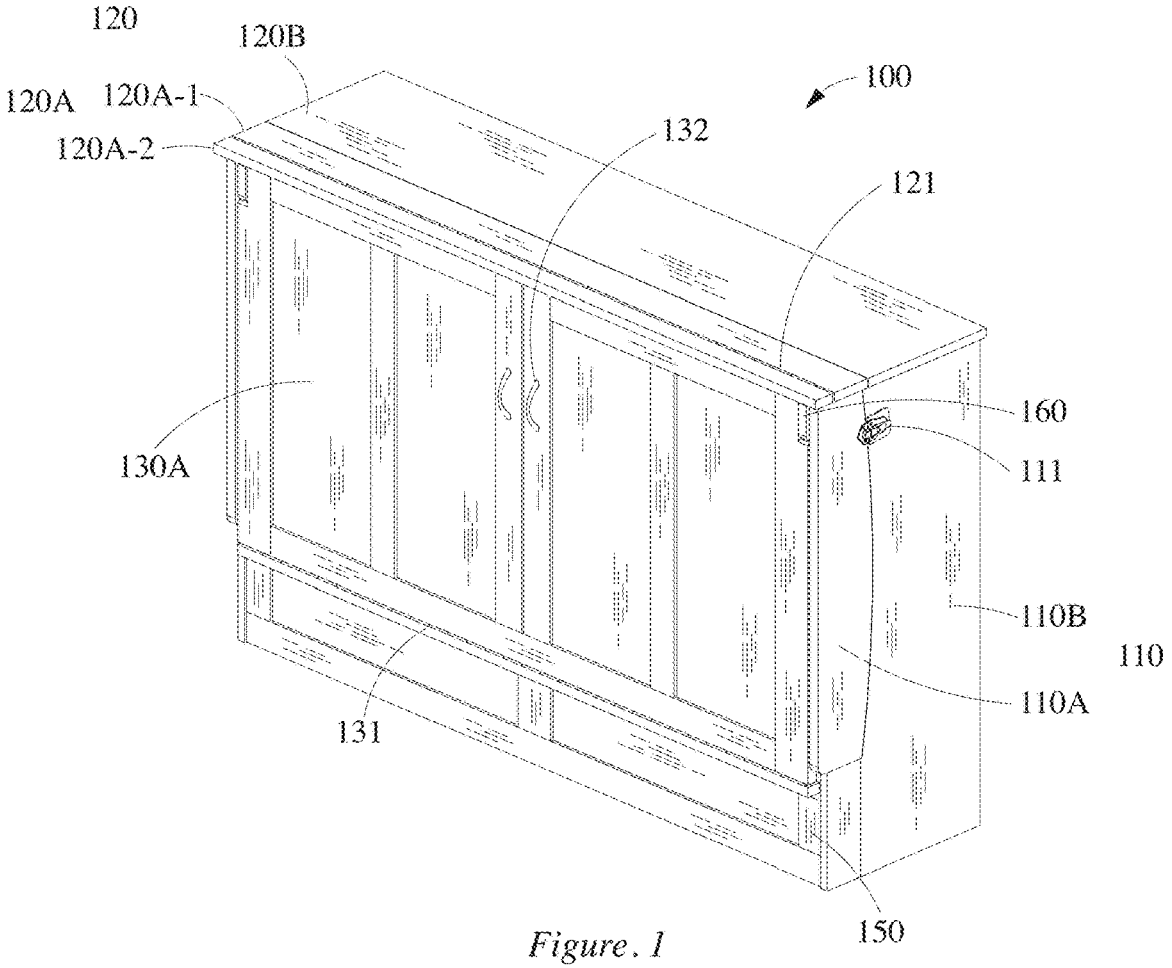
FIGS. 1 to 4 illustrate a chest configured to store a foldable bed in a closed or folded position according to example embodiments.
Figure 2:
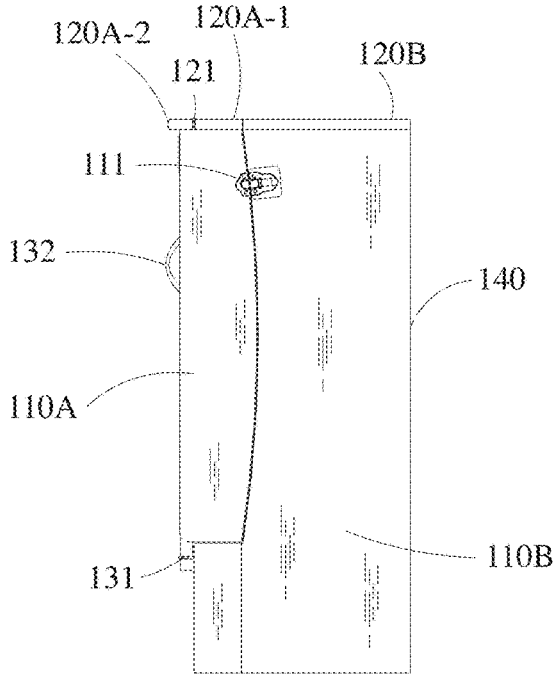
Figure 3:
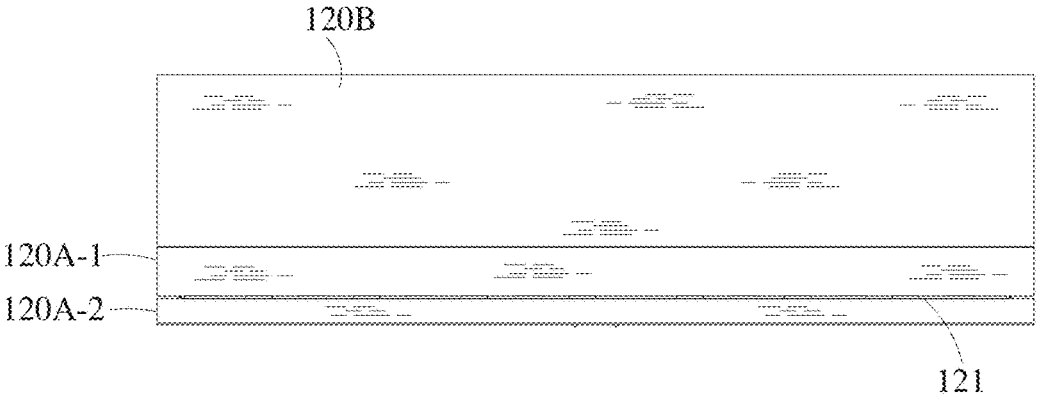
Figure 4:
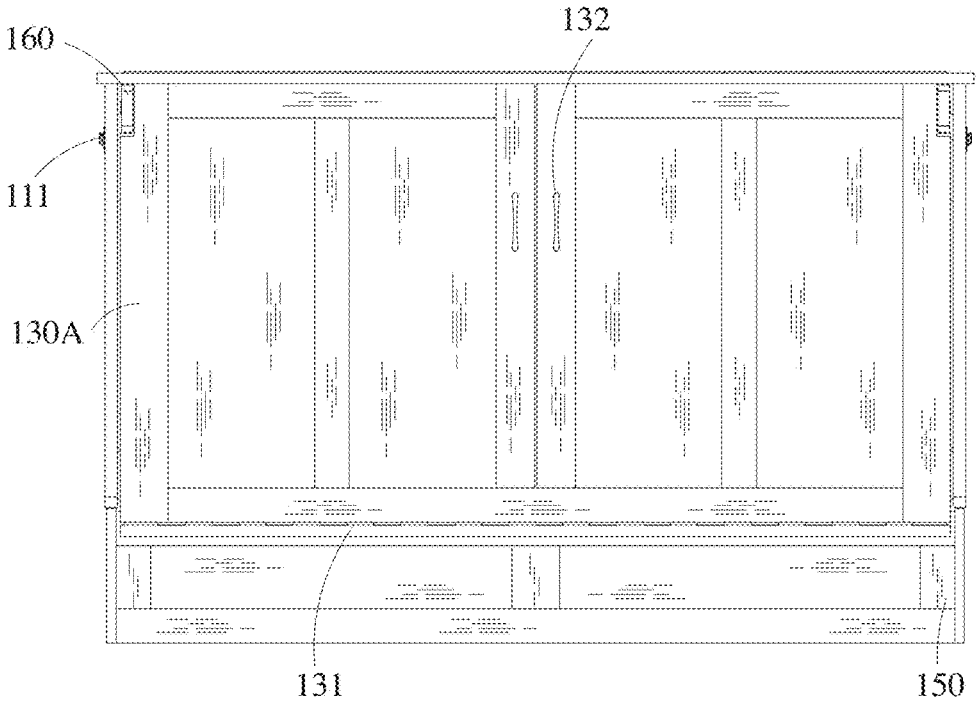

The following description is merely example in nature and is not intended to limit the present disclosure, application, or uses. It should be understood that throughout the drawings, corresponding reference numerals indicate like or corresponding parts and features.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the concept of the invention to those skilled in the art.

Example embodiments relate to a furniture object configured to store a foldable bed. Example embodiments provide that the furniture object may be a chest, cabinet, coffer, trunk or any other like furniture object configured and/or adaptable to store a foldable bed. The furniture object described herein may be constructed, manufactured, or otherwise built in a variety of shapes include any rectangular shape, square shape, and/or any other like shape. The furniture objects described herein may be constructed, manufactured, or otherwise built using a variety of materials, such as wood, plastic, metal, minerals and/or any combination thereof.

FIGS. 1 to 4 illustrate a chest configured to store a foldable bed in a closed or folded position according to example embodiments;

Referring to FIGS. 1-4, a chest 100 includes side panels 110, a top panel 120, a front panel 130, a back panel 140, and a base 150 which may be visible when the chest 100 is in the closed position.

The side panels 110 may include a first sub-side panels 110A and second sub-side panels 110B. Each of the first sub-side panels 110A are configured to secure to a corresponding one of the second sub-side panels 110B via a clasp 111. The side panels 110 may be provided in plural such that one of the side panels 110 is provided on each side of the chest 100.

The top panel 120 includes a first sub-top panel 120A and a second sub-top panel 120B. The first sub-top panel 120A may include a first portion 120A-1 and a second portion 120A-2 connected, for example, via a first hinge 121. In some example embodiments, the second hinge 121 may be a piano hinge. However, example embodiments are not limited thereto. The first sub-top panel 120A may be connected to each of the first sub-side panels 110A. For example, the first portion 120A-1 of the first sub-top panel 120A may be connected to the each of the first sub-side panels 110A and the second portion 120A-2 of the first sub-top panel 120A may extend therefrom such that the second portion 120A-2 of the first sub-top panel 120A extends beyond the face of the front panel 130. Further, the second sub-top panel 120A-2 may be connected to each of the second sub-side panels 110B.

The front panel 130 includes an outer front panel (e.g. a first portion) 130A and an inner front panel (e.g. a second portion) 130B. The inner front panel 130B may be fixed to the first portion 120A-1 of the first-sub-top panel 120A and the outer front panel 130A may be fixed to the second portion 120A-2 of the first-sub-top panel 120A such that the outer front panel 130A and the inner front panel 130B are connected via the first hinge 121. The outer front panel 130A may be connected to the base 150 via a second hinge 131. In some example embodiments, the second hinge 131 may be a piano hinge. However, example embodiments are not limited thereto.

While it may appear in FIG. 1 that the outer front panel 130A is attached to the first sub-side panels 110A, as will be discussed later, the outer front panel 130A may be adjoined to the first sub-side panels 110A when the chest 10 is in the closed position but may not be directly fixed to the first sub-side panels 110A.

The outer front panel 130A include one or more handles 132 provided to assist in transitioning the chest 100 from the closed position to the open position. The handles 132 may be any type of handle, knob, latch, hook or and/or any other like protrusion or void that allows an operator to manually grip the top panel 110. Further, the outer front panel 130A may include pivoting guards 160 therein. For example, the outer front panel 130A may include a pair of the pivoting guards 160 in upper corners thereof. As will be discussed in more detail below, the pivoting guards 160 may be secured by pivot points to, for example, the outer front panel 130A.

The lower front panel 130B may include side portions attached to each of the second sub-side panels 110B, where the first sub-side panels 110A are configured to abut the side portions of the lower front panel 130B when the chest 100 is in the closed position such that a sum of the height of the side portions of the lower front panel 130B and the first sub-side panels 110A is equal to a height of the second sub-side panels 110B.

Figure 25:
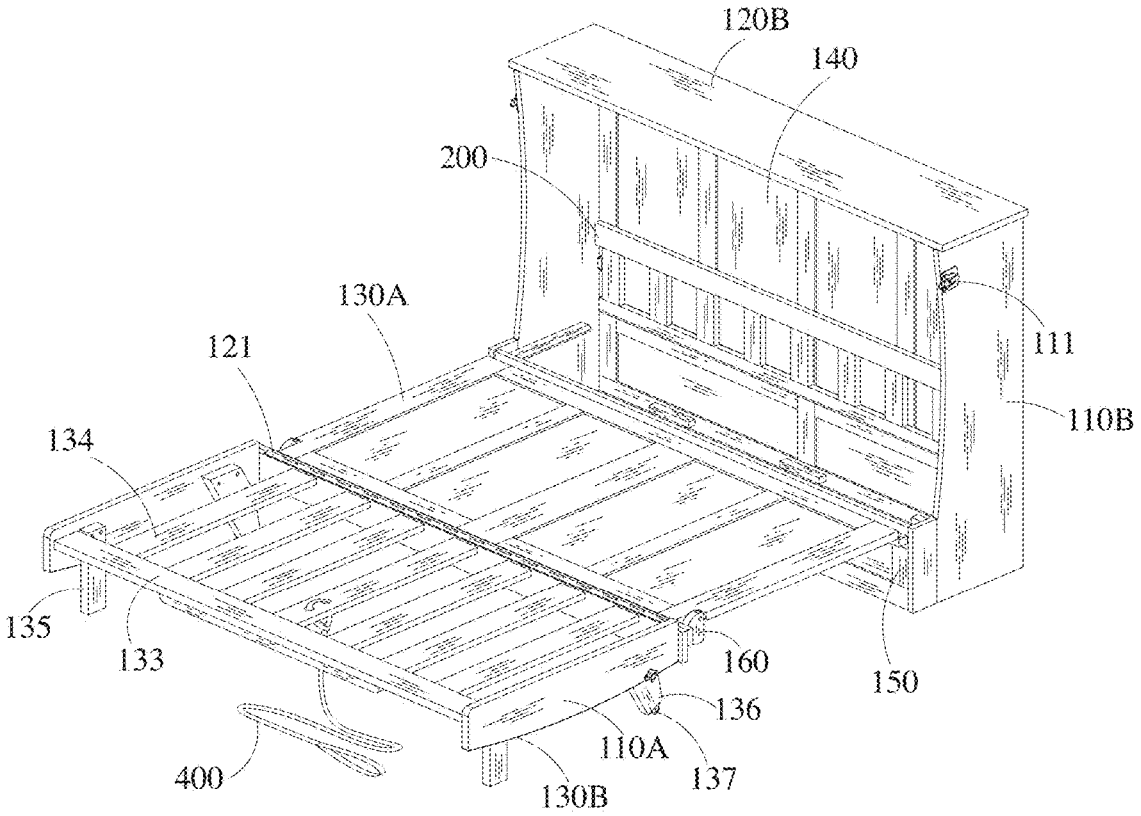
Figure 26:
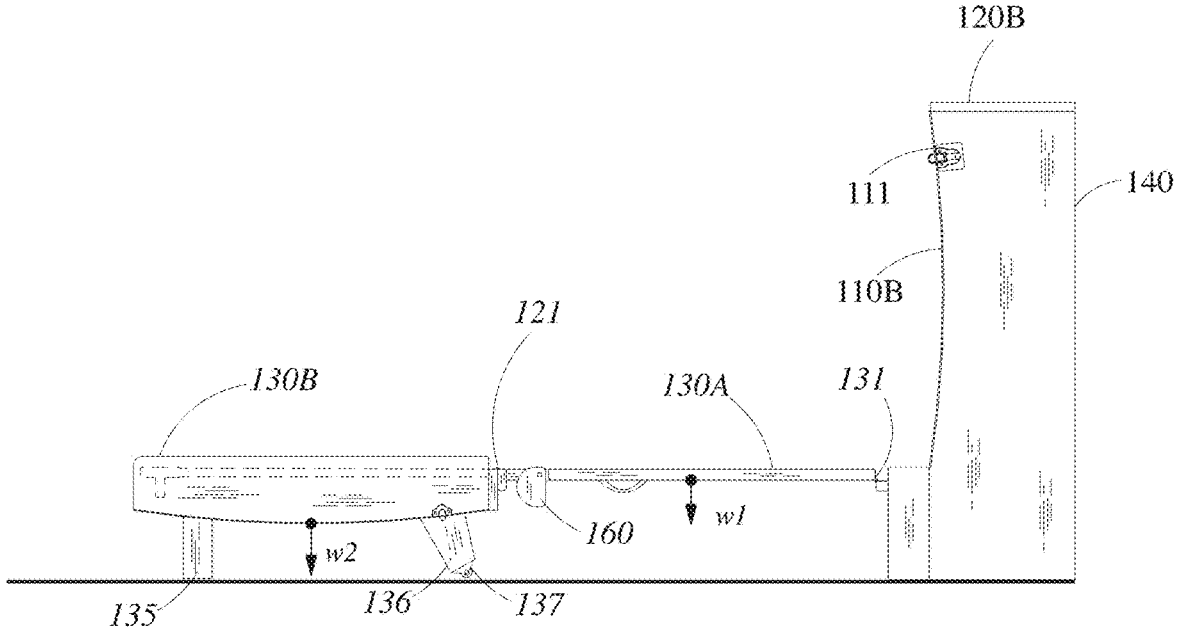
Figure 27:
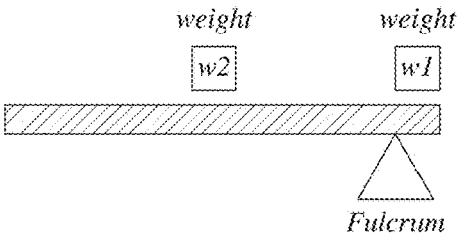
Figure 28:
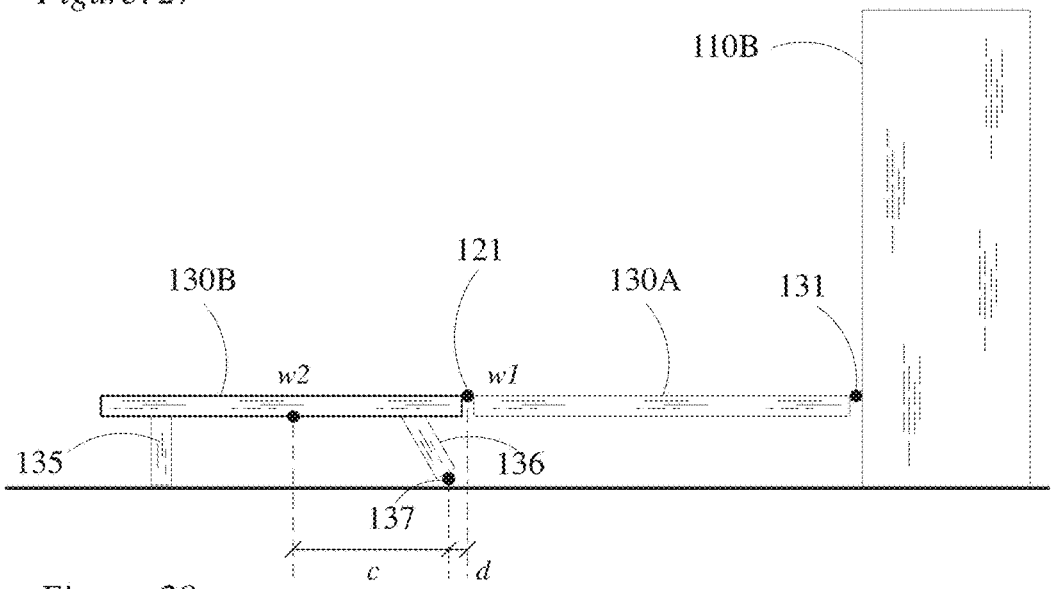

The chest 100 in the closed position is configured store a foldable mattress 500 (see FIGS. 25 and 26) in an enclosure formed by the side panels 110, the top panel 120, the front panel 130, and the back panel 140. The foldable mattress 500 may be in a folded position when stored in the enclosure.

As discussed in more detail below, the chest 100 may transition from the closed position via movement of the outer front panel 130A, the first sub-side panels 110A and the first sub-top panel 120A from the closed position in which the outer front panel 130A is parallel to a surface of the base 150, to a downward position in which the outer front panel 130A is perpendicular to the surface of the base 150.

When the chest 100 is in the open position, the back panel 140 may function as a headboard for the foldable mattress 500.

Further, as discussed in more detail below, in addition to the side panels 110, the top panel 120, the front panel 130, and the back panel 140, which may be visible when the chest 100 is in the closed position, the chest 100 may further include a folding slat deck 200.

Further, as discussed in more detail below, in some example embodiments, a rear folding leg assembly 300 may be connected to the first sub-side panels 110A and selectively extend therefrom to provide additional support to the sleeping platform.

Figure 5:
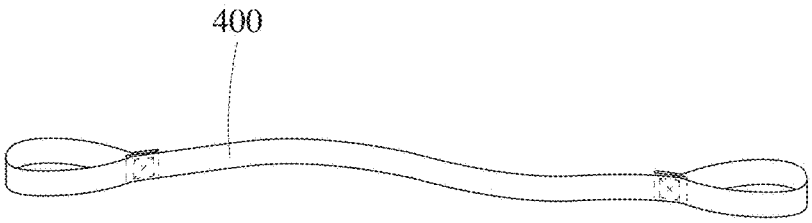
FIG. 5 illustrates a strap used to convert the chest between a closed or folded position and an open or unfolded position according to example embodiments.
Figure 6:
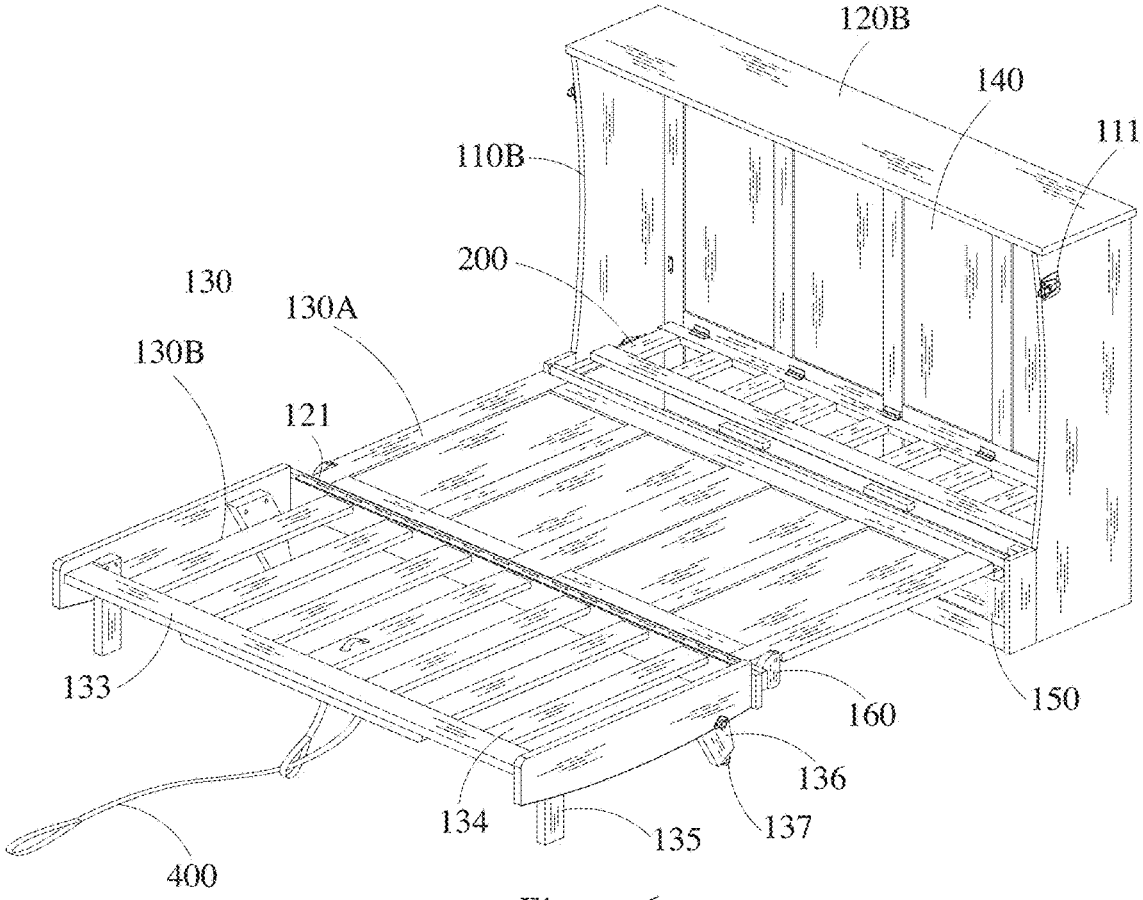
FIGS. 6 to 9 illustrate a chest in an open or unfolded position according to example embodiments.
Figure 7:
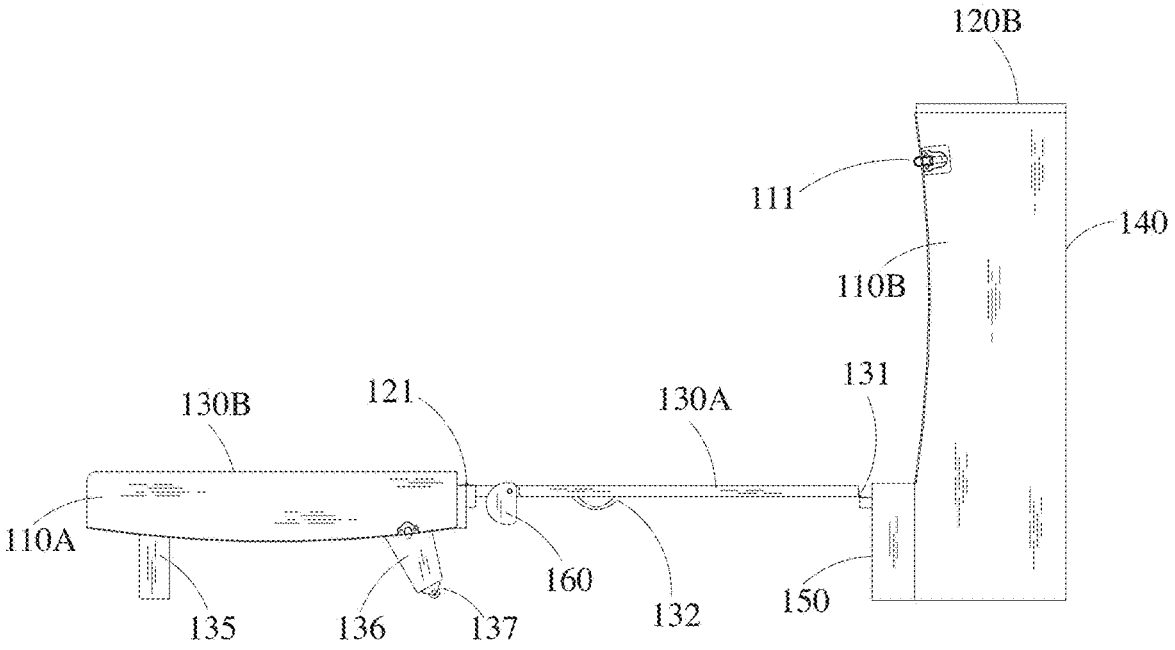
Figure 8:
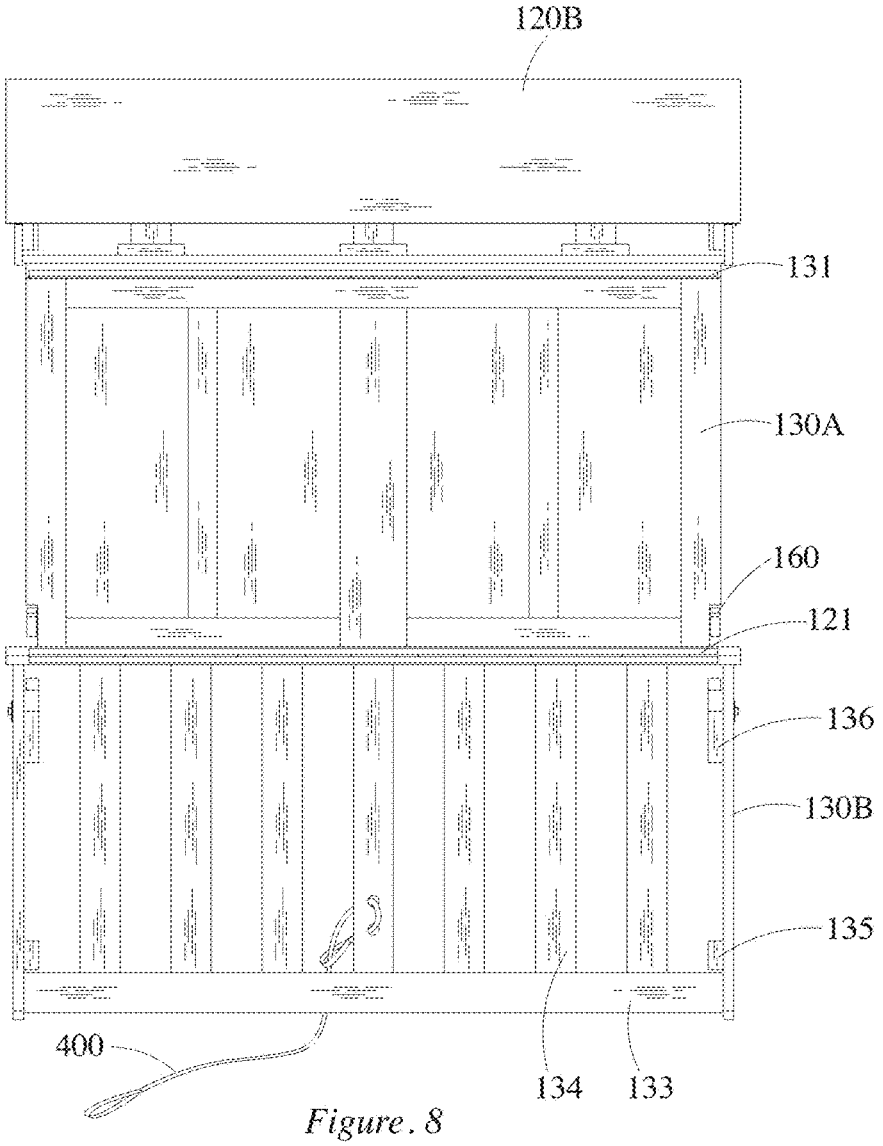
Figure 9:
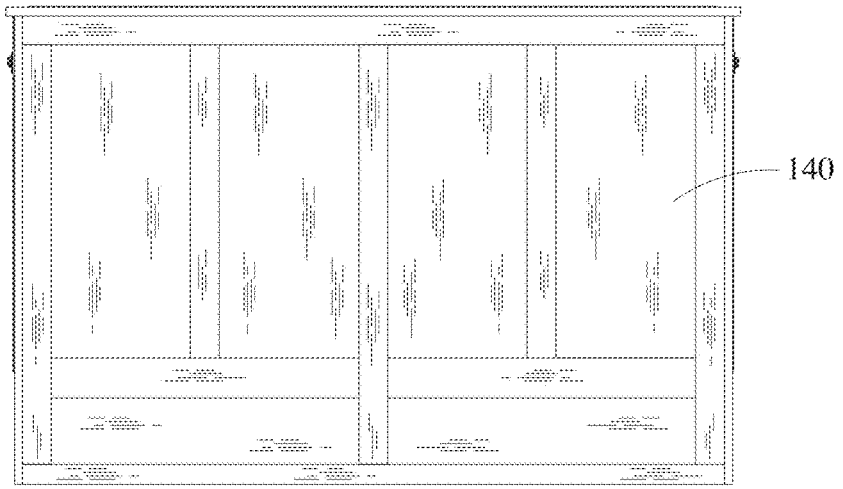

FIG. 5 illustrates a strap used to convert the chest between a closed or folded position and an open or unfolded position according to example embodiments. FIGS. 6 to 9 illustrate a chest in an open or unfolded position according to example embodiments.

Referring to FIGS. 5 to 9, when the chest is in the open or unfolded position, the first sub-side panels 110A are detached from the second sub-side panels 110B, the first sub-top panel 120A is detached from the second sub-top panel 125B and the front surface of the outer front panel 130A is folded downwards such that the front surface is parallel to a surface of the ground and perpendicular to a position of the front surface when the chest 100 is in the closed position.

Further, as shown in FIGS. 5 to 9, in addition to the top panel 110, the front panel 120, the side panels 140, and the back panel 150, which may be visible when the chest 100 is in the closed position, the chest 100 may further include the folding slat deck 200 in an inside thereof. Further, a strap 400 may be attached to the inner front panel 130B.

The folding slat deck 200 may be attached to, for example, the back panel 140 (or rear supports associated therewith) via one or more third hinges 210. However, example embodiments are not limited thereto. For example, the folding slat deck 200 may be pivotally connected to the side panels 140 via protrusions protruding from a rear of a first one of the second sub-side panels 110B and the folding slat deck 200 that are connected to respective openings in a rear of a second one of the second sub-side panels 110B and the folding slat deck 200. Further, in other example embodiments, the folding slat deck 200 may simply be manually liftable and/or foldable without including any connection between the folding slat deck 200 and the chest 100. By having the folding slat deck 200 foldable between the folded position and the unfolded position, the mattress 500 may sit substantially deeper in the enclosure until needed, thus, substantially reducing the height of the chest 100.

In regards to the upper sleeping platform, the folding slat deck 200 may transition between a folded position (see FIG. 25) and an unfolded position (see FIG. 30), where the folding slat deck 200 may rest against supports on the inside of at least the second sub-side panels 110B in the unfolded position to form the upper sleeping platform. The supports may extend towards an interior of the enclosure an amount such that the supports do not interfere with placement of the mattress 500 in the enclosure when the mattress 500 is in the folded position.

The inner front panel 130B may be connected to the first sub-side panels 110A and the first portion 120A-1 of the first sub-top panel 120A such that the inner front panel 130B is connected to the outer front panel 130A via the first hinge 121. The inner front panel 130B may include a rail 133 connected between the two first sub-side panels 110A and a plurality of slats 134. The plurality of slats 134 may be secured between the first portion 120A-1 of the first-sub-top panel 120A and the rail 133. However, example embodiments are not limited thereto. For example, the inner front panel 130B may include a solid surface rather than the plurality of slats 134.

Further, the inner front panel 130B may include front legs 135 and rear legs 136 attached thereto. The rear legs 136 may include rollers 137 attached to a bottom surface thereof. In some example embodiments, as illustrated in, for example, FIGS. 6 and 7, the rear legs 136 may be secured a distance away from the first portion 120A-1 of the first sub-top panel 120A and angled towards the rear of the inner front panel 130B to allow sufficient clearance between the rear legs 136 and the top panel 120 when the inner front panel 130B is folded into the chest 100. However, as discussed in more detail below with reference to FIGS. 36-43, example embodiments are not limited thereto.

At least the folding slat deck 200, the inside surface of the outer front panel 130A and the slats 134 on the inner front panel 130B may together form a sleeping platform to support a weight of the mattress 500 thereon when the outer front panel 130A is folded a downwards direction (e.g., 90 degrees), the folding slat deck 200 is unfolded in a downwards direction (e.g., 90 degrees) and the lower support is unfolded (e.g., 180 degrees) such that the front legs 135 and the rear legs 136 contact a ground. In the open or unfolded position the combined weight of the sleeping platform and the mattress 500 may be supported by the front legs 135, the rear legs 136 and the base 150 of the chest 100.

Figure 10:
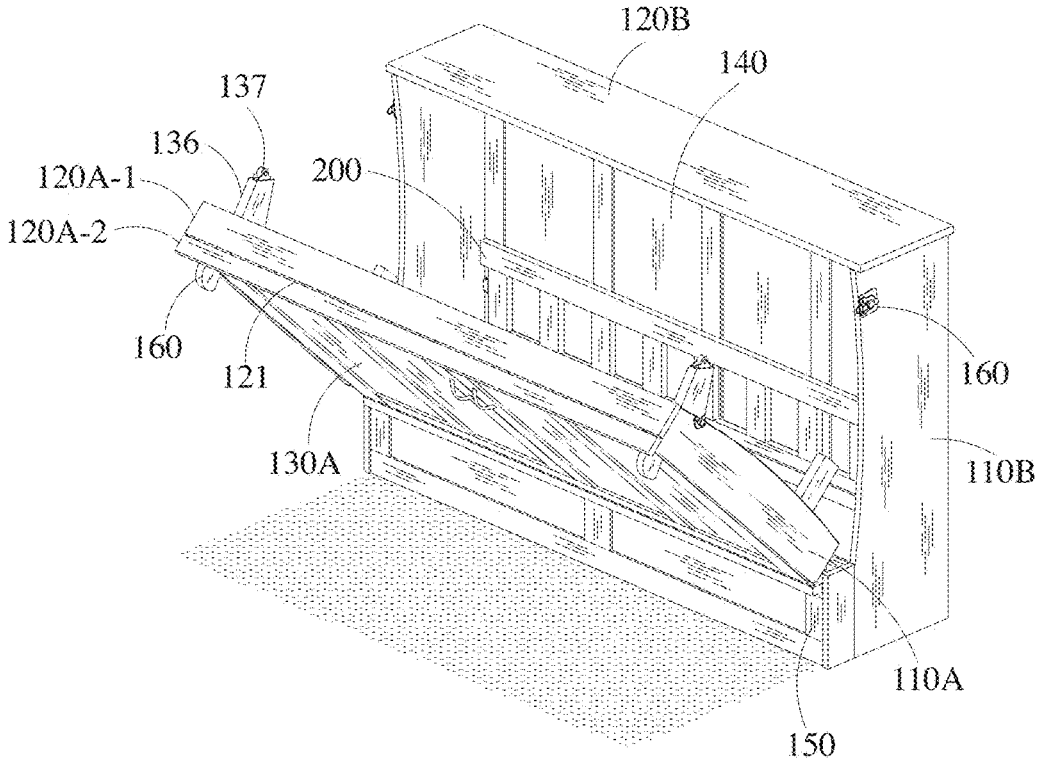
FIGS. 10 to 28 illustrate a method of unfolding a chest from an closed or folded position to an open or unfolded position according to example embodiments.
Figure 11:
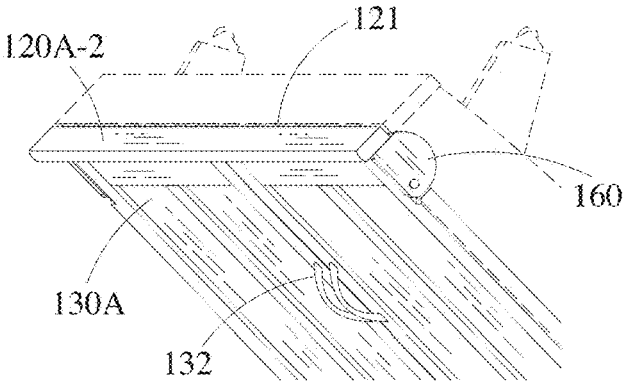
Figure 12:
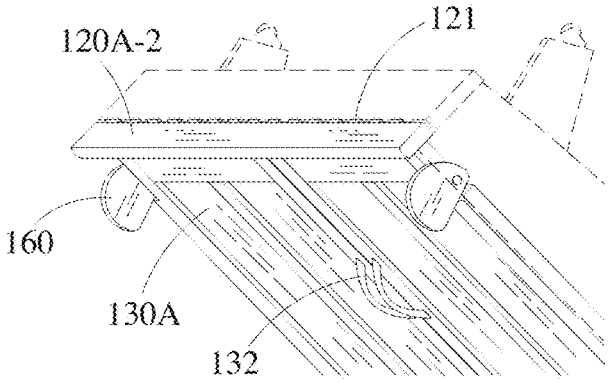

FIGS. 10 to 24 illustrate a method of unfolding a chest from an closed or folded position to an open or unfolded position according to example embodiments;

Referring to FIGS. 10 to 28, as illustrated in FIGS. 10 to 12, in a first operation to unfold the chest 100, the first sub-side panels 110A, the first sub-top panel 120A, the outer front panel 130A along with the inner front panel 130B attached thereto may be folded downwards from a first position in which the outer front panel 130A is substantially parallel with the front of the base 150, towards a second position in which the outer front panel 130A is perpendicular to the front of the base 150. As the outer front panel 130A moves from the first position to the second position, the pivoting guards 160 attached to, for example, the outer front panel 130A may pivot about a pivot point thereof. As illustrated in FIGS. 10 to 12, the pivot point of the pivoting guards 160 may be offset towards a side thereof closest to the second hinge 131 such that a weight of the pivoting guards 160 urges the pivoting guards 160 to automatically pivot outwards from a first position to a second position as the outer front panel 130A moves from the first position to the second position and may secure the pivoting guards 160 in the second position against a force applied in a direction substantially perpendicular to the outer front panel 130A. However, example embodiments are not limited thereto. For example, in some example embodiments, rather than having pivoting guards 160, the chest 100 may include fixed guards that extend from, for example, the outer front panel 130A to inhibit (or, alternatively, prevent) the outer front panel 130A from directly contacting the ground by maintaining a gap between the outer front panel 130A and the ground.

Note also, as illustrated in FIGS. 10 to 12, that due to the angling of the rear legs 136, a sufficient clearance may be secured to allow the inner front panel 130B including the rear legs 136 to extend from within the chest 100 without interacting with the top panel 120.

Figure 13:
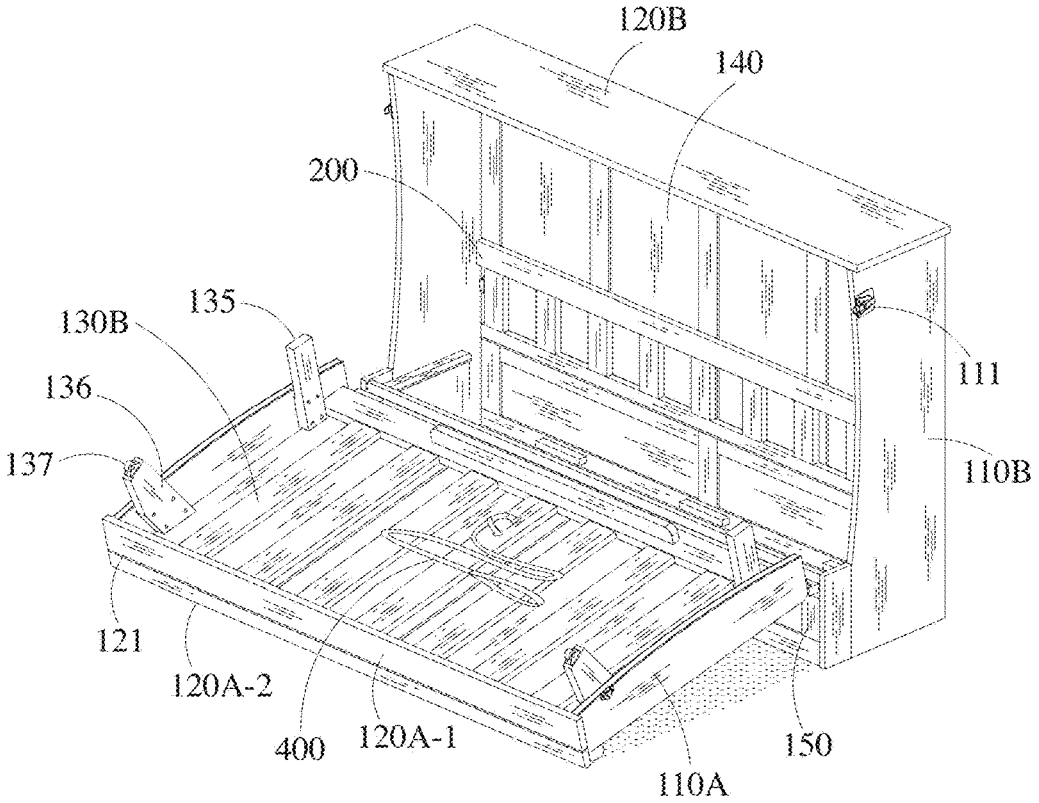
Figure 14:
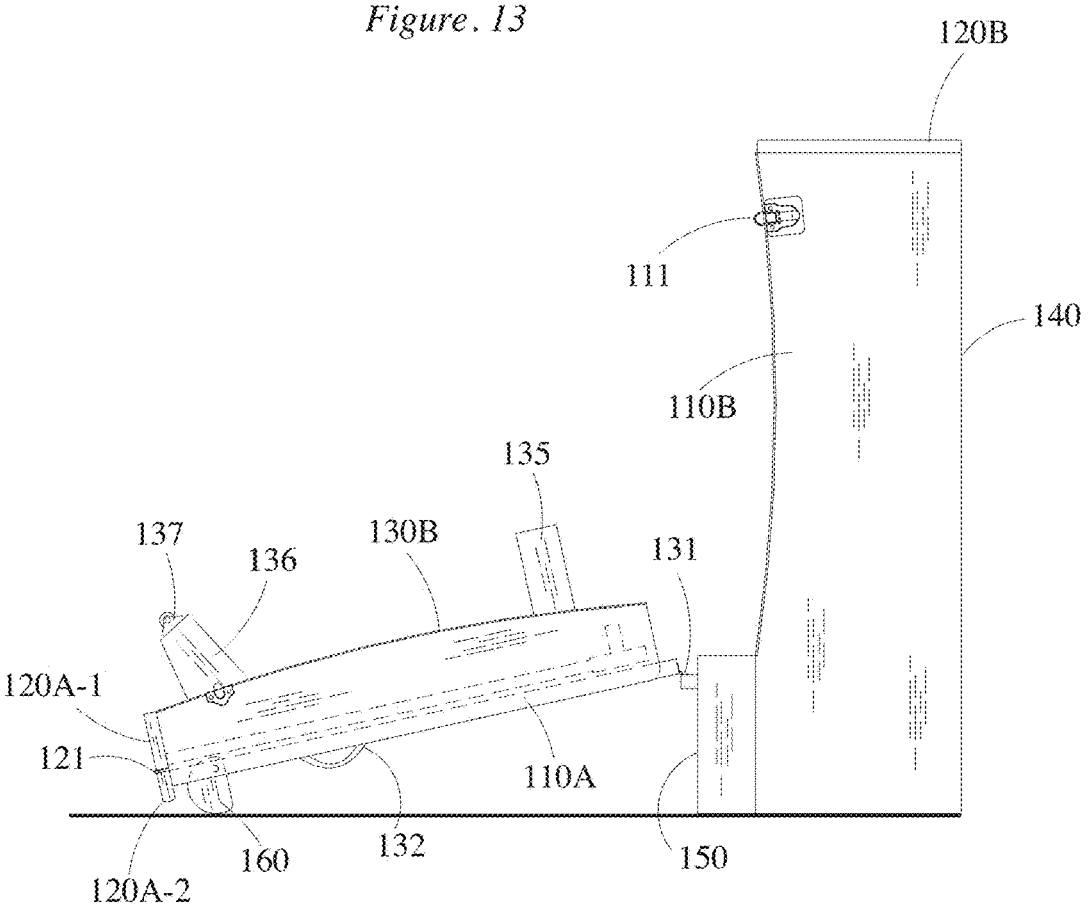
Figure 15:
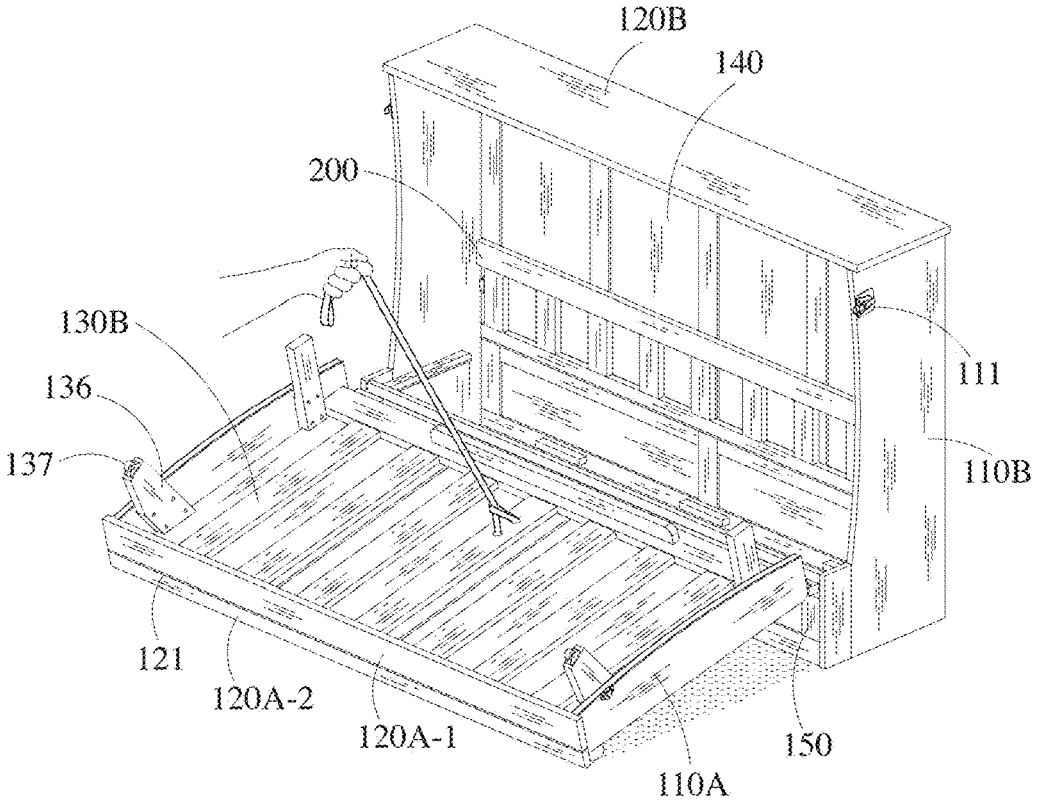
Figure 16:
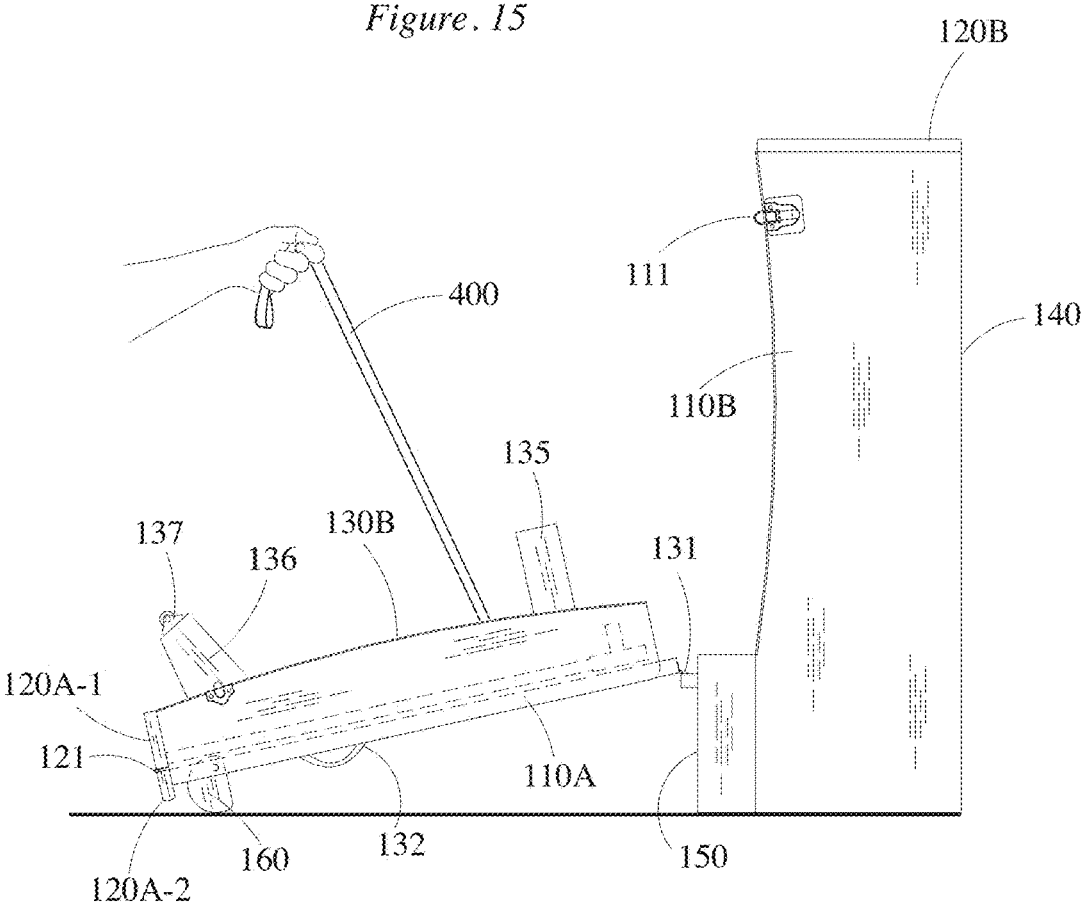
Figure 17:
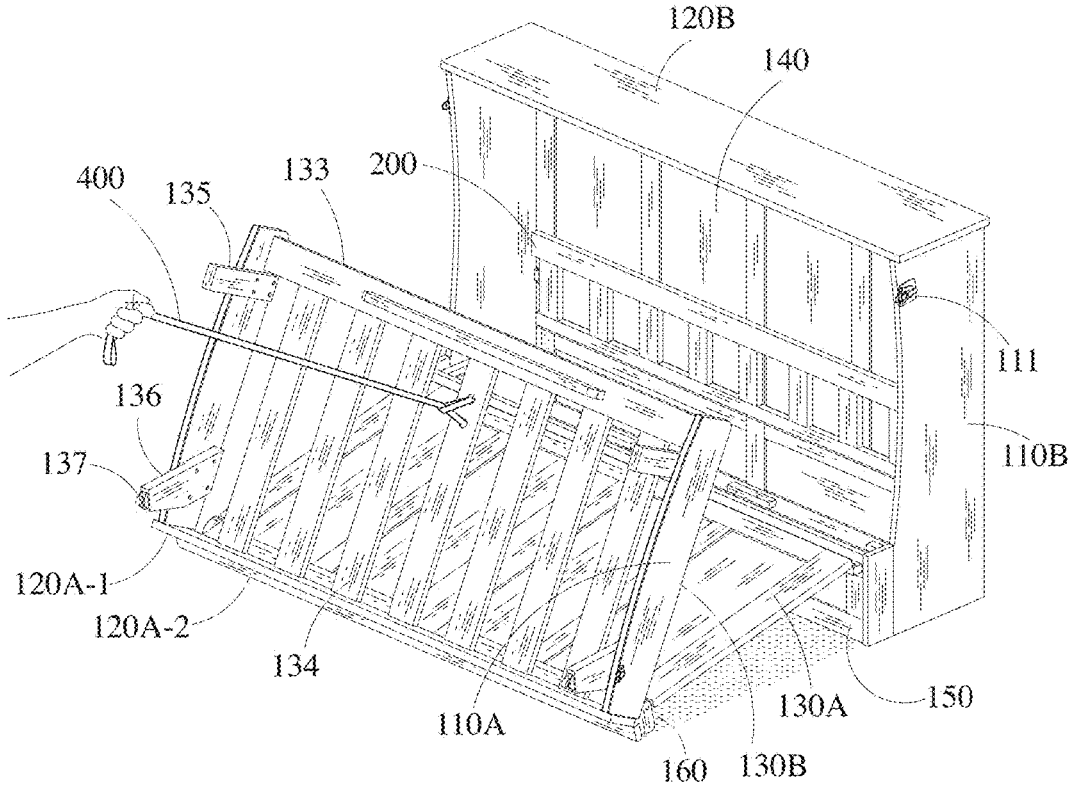
Figure 18:
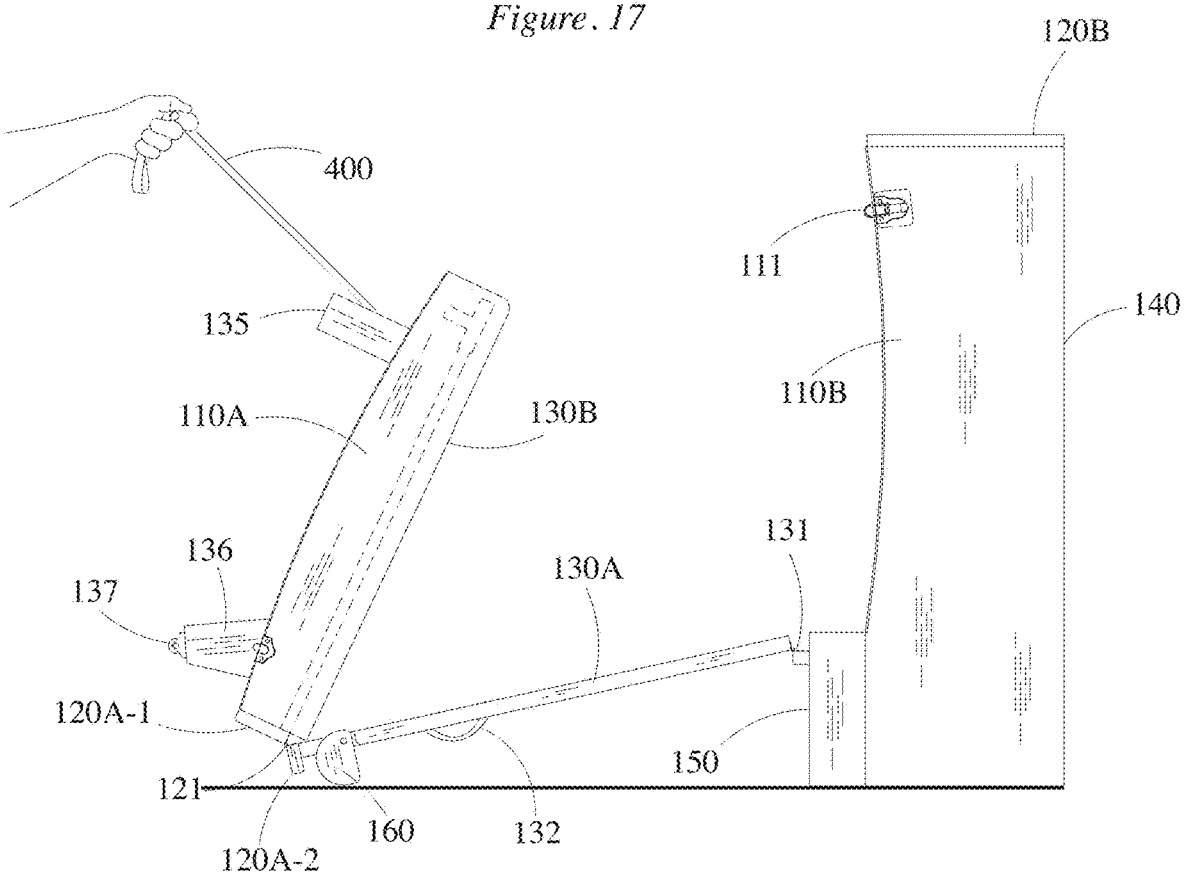
Figure 19:
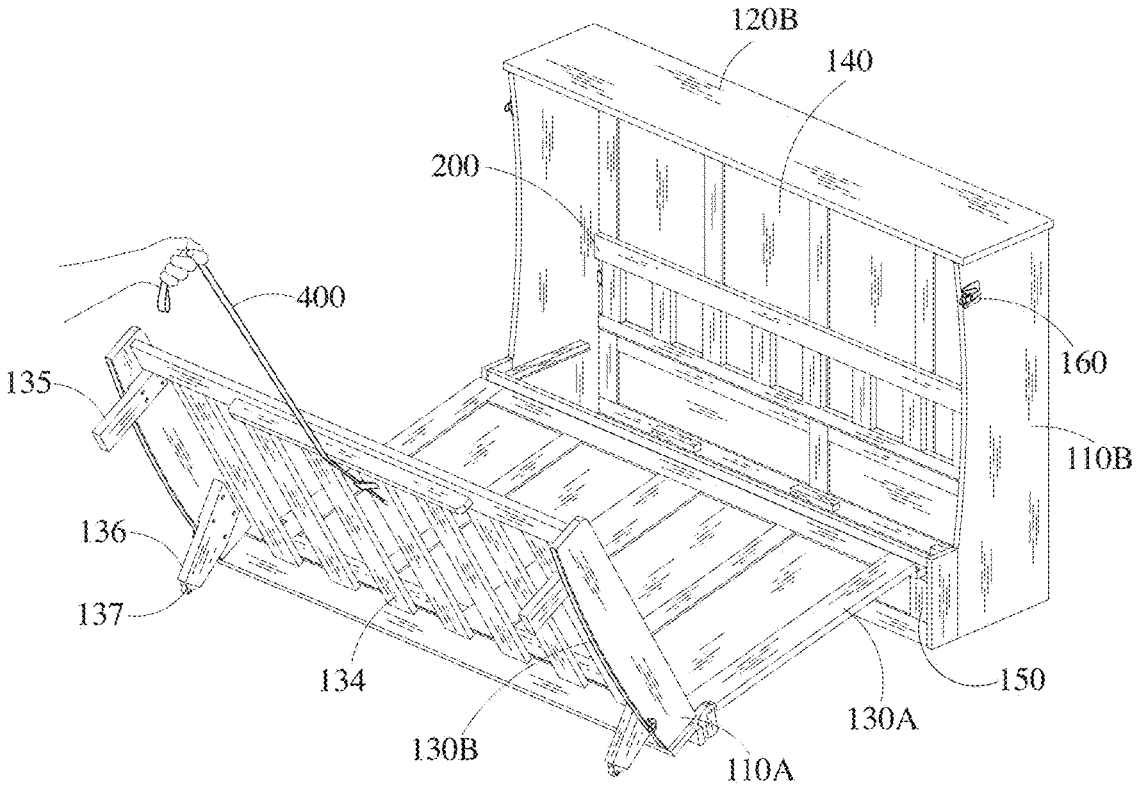

As illustrated in FIGS. 13 and 14, in a second operation to unfold the chest 100, the first sub-side panels 110A, the first sub-top panel 120A, the outer front panel 130A along with the inner front panel 130B attached thereto may be further unfolded so that the pivoting guards 160 contact a ground. As discussed above, the pivot point of the pivoting guards 160 may be offset such that the pivoting guards 160 are secured in the second position against a force applied in a direction substantially perpendicular to the outer front panel 130A. Therefore, the pivot guards 160 may inhibit (or, alternatively, prevent) the outer front panel 130A from directly contacting the ground, thus, enhancing the durability of the chest 100 without the costs and weight associated with a set of rails stored within the chest 100 to support the outer front panel 130A.

As illustrated in FIGS. 15-20, in a third operation to unfold the chest 100, a user may begin to unfold the inner front panel 130B by, for example, pulling on the strap 400 until the rear legs 136 (e.g., the rollers 137 attached thereto) contact the ground. At this juncture, the pivoting guards 160 may still contact the ground and support a portion of the sleeping platform.

Figure 20:
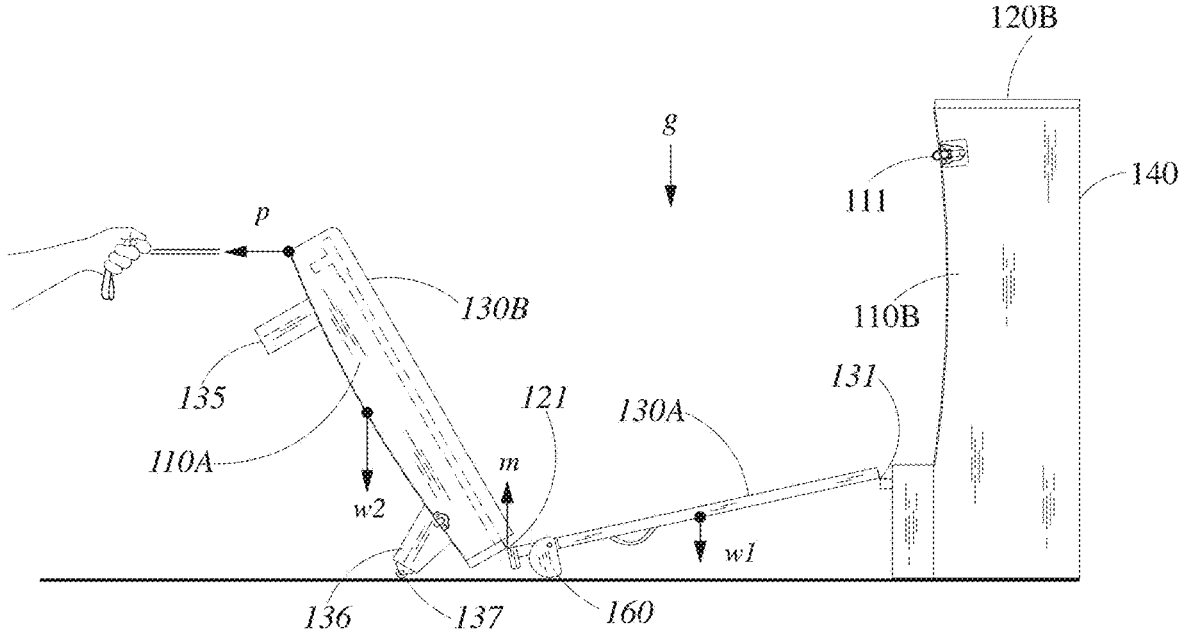

Referring to FIG. 20 in conjunction with FIGS. 15-19, after performing the first to third operations to unfold the chest 100, the sleeping platform will arrive at the position shown in FIG. 20, which is a static state of rest for all components. For example, the outer front panel 130A has been lowered to the floor with a weight w1 thereof supported by the hingeable connection at one end to the base 150 by the second hinge 131 and on the other end by the pivoting guards 160 sitting on the floor. Accordingly after performing the first to third operations, the outer front panel 130A is at rest and static under a force of gravity g. Likewise, the inner front panel 130B is also at rest with the inner front panel 130B being hingably attached to the outer front panel 130A by the first hinge 121 with the center of the weight w2 of the inner front panel 130B supported between the roller 137 and the first hinge 121.

In this rest state, the sleeping platform may form a lever with the roller 137 considered a fulcrum of the lever with the weight w2 of the inner front panel 130B acting on a left of the fulcrum, and counter-balanced by a portion the weight w1 of the outer front panel 130A acting through the second hinge 131 with the remaining portion of the weight w1 of the outer front panel 130A supported through the pivoting guards 160.

A lever may be defined based on a location of the input force (effort), the fulcrum, and the resistance (the load) with a class 1 lever having the fulcrum placed between the effort and load, a class 2 having the load between the effort and the fulcrum and a class 3 lever having the effort between the load and the fulcrum. In the example embodiment shown in FIG. 20, the sleeping platform may form a class 1 lever with the fulcrum defined by the roller 137 being between the input force p and the resistance or load provided a portion of the weight w1 of the outer front panel 130A.

In a fourth operation to unfold the chest 100, the user may continue to unfold the inner front panel 130B by, for example, pulling further on the strap 400 to provide an input force p to the lever formed by the sleeping platform.

Referring to FIG. 20 in conjunction with FIGS. 21 to 24, to bring the outer front panel 130A and the inner front panel 130B into a single horizontal plane to form a portion of the sleeping platform that supports the mattress 500, an external force p that overcomes the weight w1 of the outer front panel 130A may be applied by the user resulting in upward movement m of the outer front panel 130A.

Figure 24:
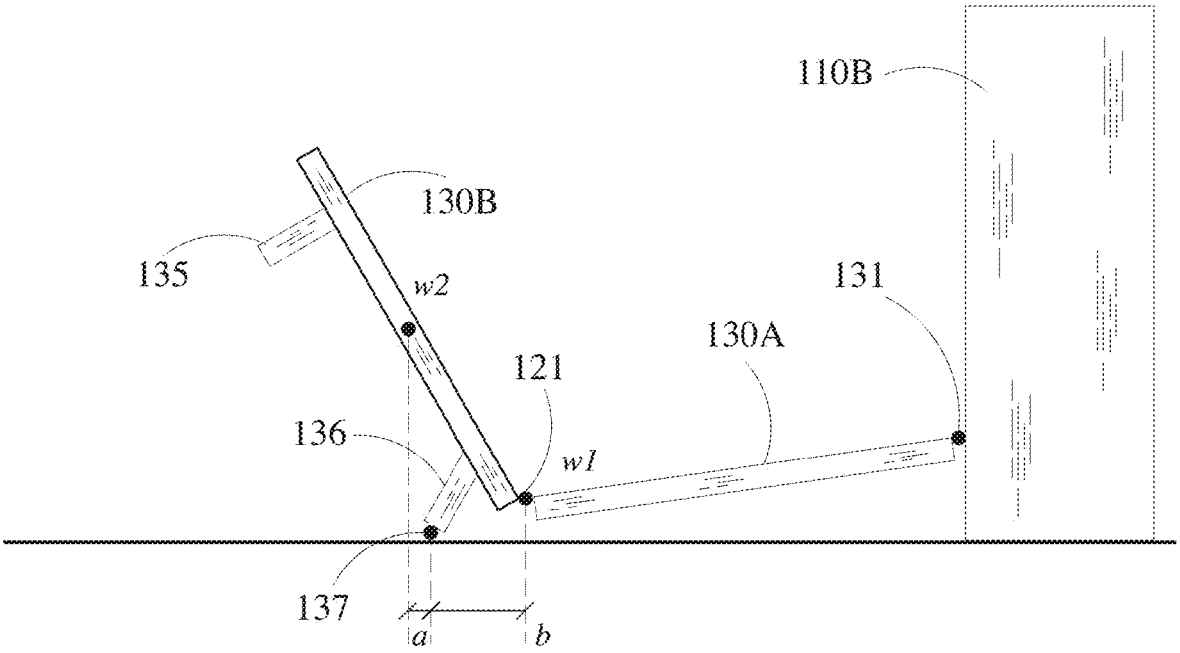

Due to the configuration of the lever, the external force p applied by the user is aided by the force of the weight w2 of the lower support since both forces are on a same side of the fulcrum defined by the roller 137. As illustrated in FIG. 24, in this position, the distance "a" between the center of the weight w2 of the inner front panel 130B and the fulcrum (e.g., the roller 137) is substantially larger than the distance "b" between the center of the weight w1 of the outer front panel 130A and the fulcrum. As such, the inner front panel 130B may provide a mechanical advantage, to reduce (or, alternatively, minimize) the external force p provided by the user to bring the outer front panel 130A and the inner front panel 130B into the single horizontal plane. The downwards motion of the inner front panel 130B and the lifting of the outer front panel 130A in the fourth operation tends to move the center of the weight w2 of the inner front panel 130B further from the fulcrum such that the magnitude of the input force p provided by the user decreases as the user continues to unfold the inner front panel 130B until a transition point is reached at a mid-angle, where the input force p will diminish to zero, and the lever will be a perfect balance between the center of the weight w2 of the inner front panel 130B and the center of the weight w1 of the outer front panel 130A acting through the first hinge 121.

Figure 21:
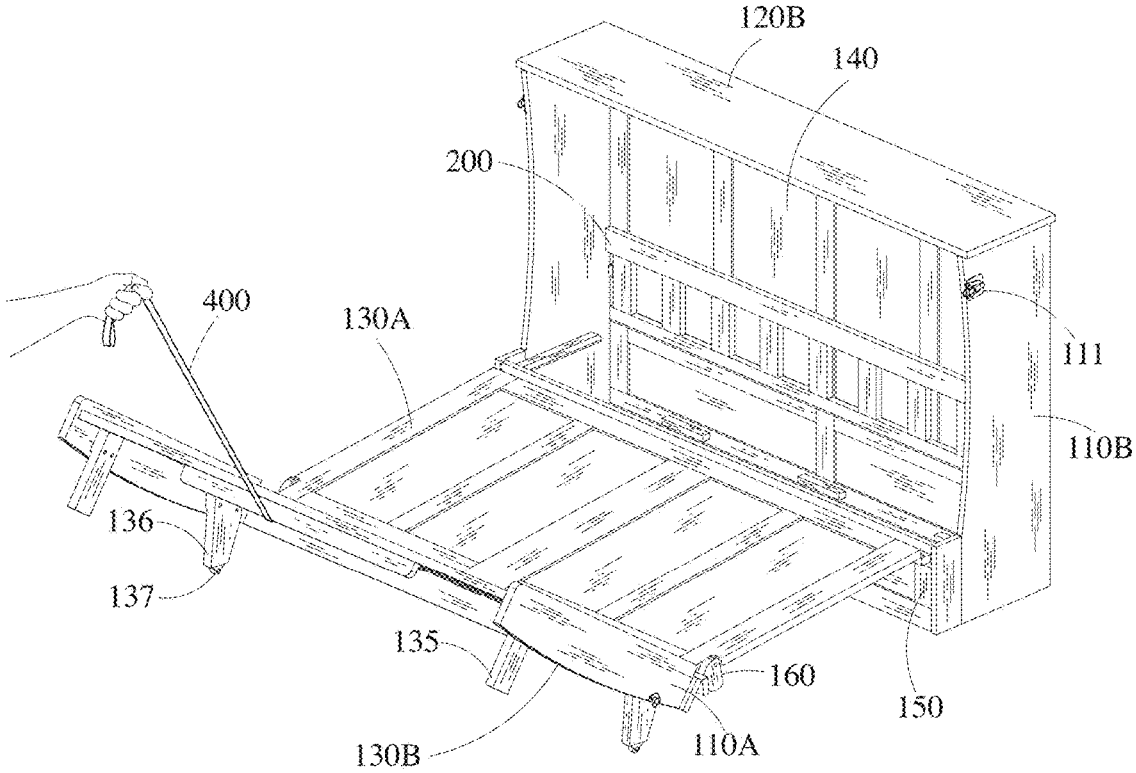
Figure 22:
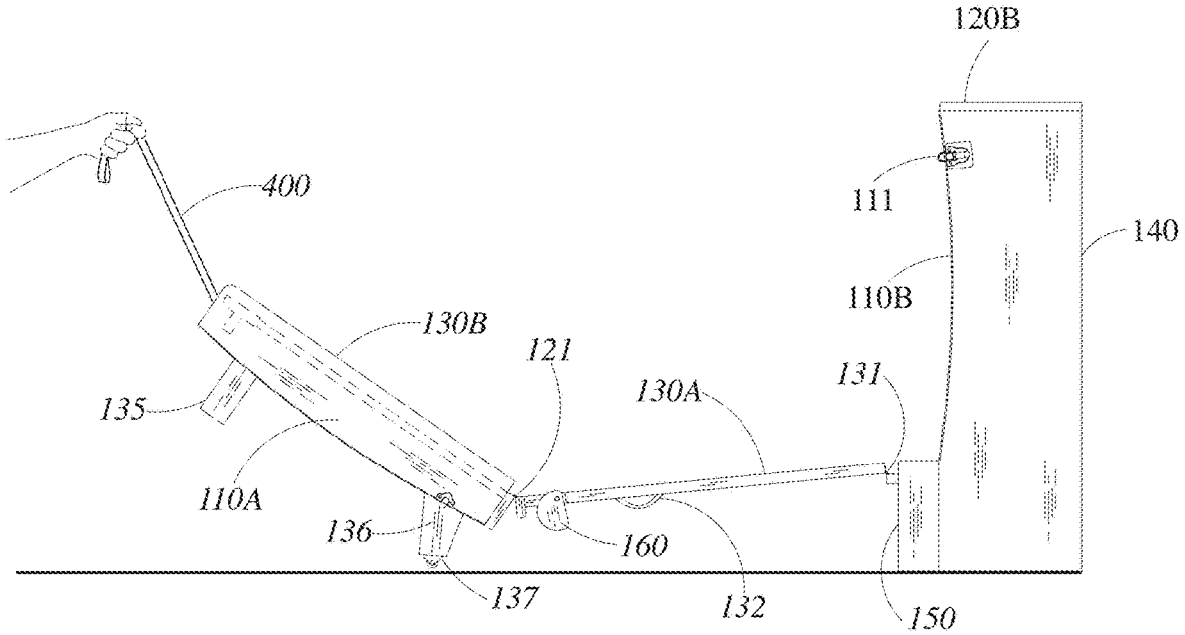
Figure 23:
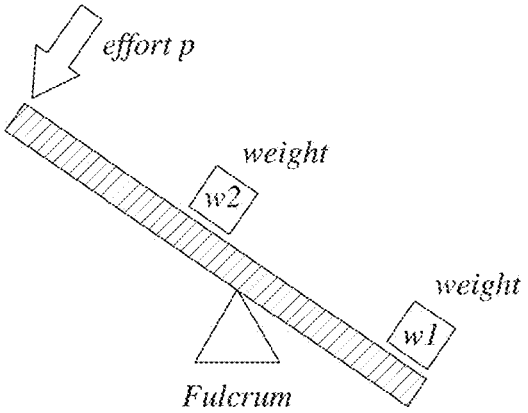

Beyond this point, as illustrated in FIGS. 21 and 22, the direction of the input force p applied by the user changes to support a portion of the weight w2 of the inner front panel 130B, until the front legs 135 are lowered to the ground to support the sleeping platform.

Referring to FIGS. 25 to 28, in the final static position, the outer front panel 130A and the inner front panel 130B are horizontal providing a portion of the sleeping platform for the mattress 500 with the weight w1 of the outer front panel 130A supported between the second hinge 131 and the first hinge 121, and the inner front panel 130B stably supported by the front legs 135 and the rear legs 136 with the roller 137 having moved rearwards coming to a final position almost under the first hinge 121.

Considering the inner front panel 130B as a lever with the fulcrum at roller 137, with the weight w2 of the inner front panel 130B on one side of the fulcrum and the weight w1 of the outer front panel 130A acting on the other side of the fulcrum, a substantial difference may exist between a distance "c" from w2 to the fulcrum as compared to a distance "d" of w1 to the fulcrum. This difference in distances may provide mechanical advantage to aid resisting the sleeping platform from collapsing back to, for example, the position of FIG. 24 due to an increase in weight from, for example, the mattress 500 and the sleeping user.

Figure 29:
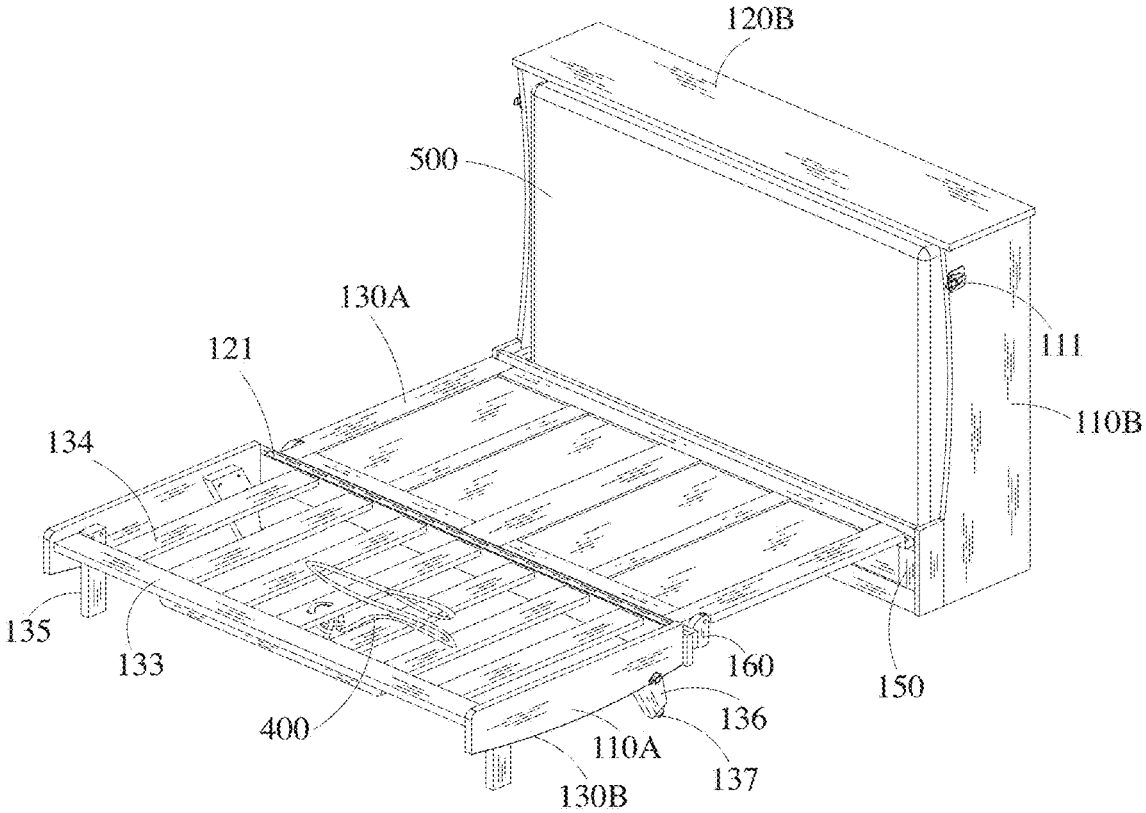
FIGS. 29 to 31 illustrate a kit including a chest configured to store a foldable bed and a mattress according to example embodiments.
Figure 30:
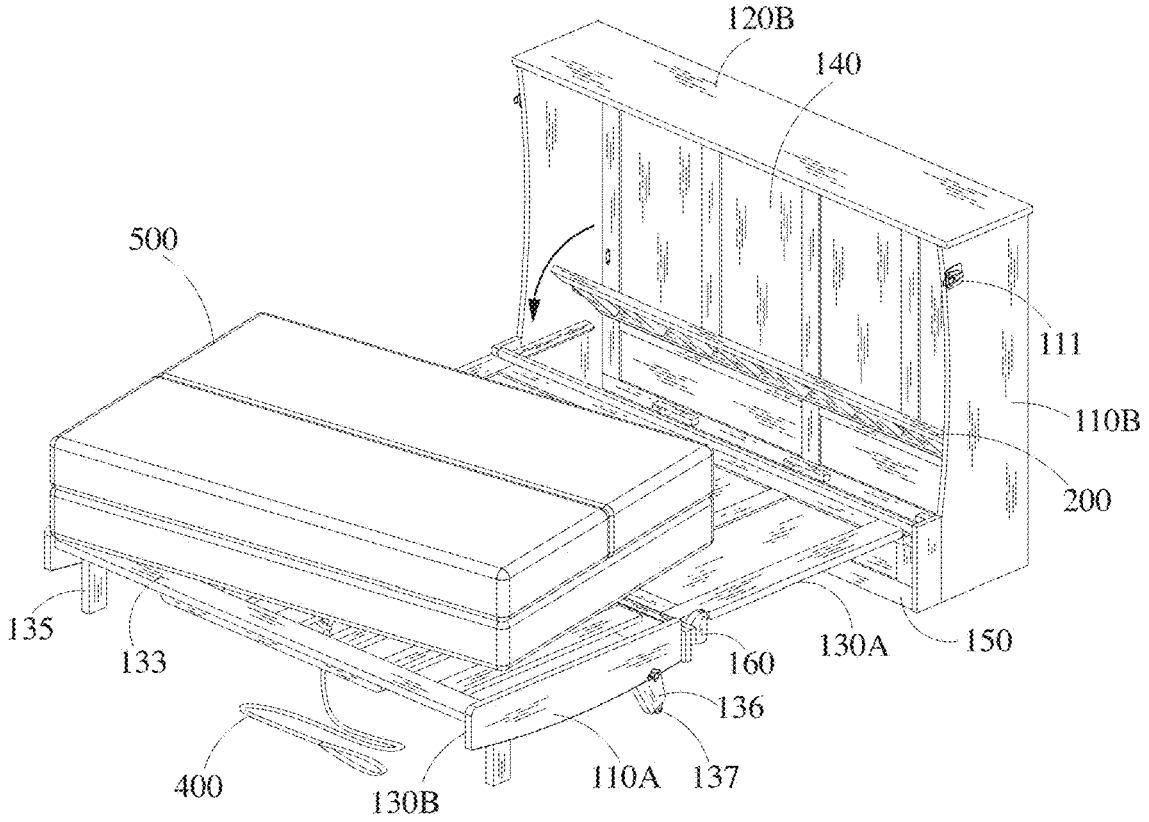
Figure 31:
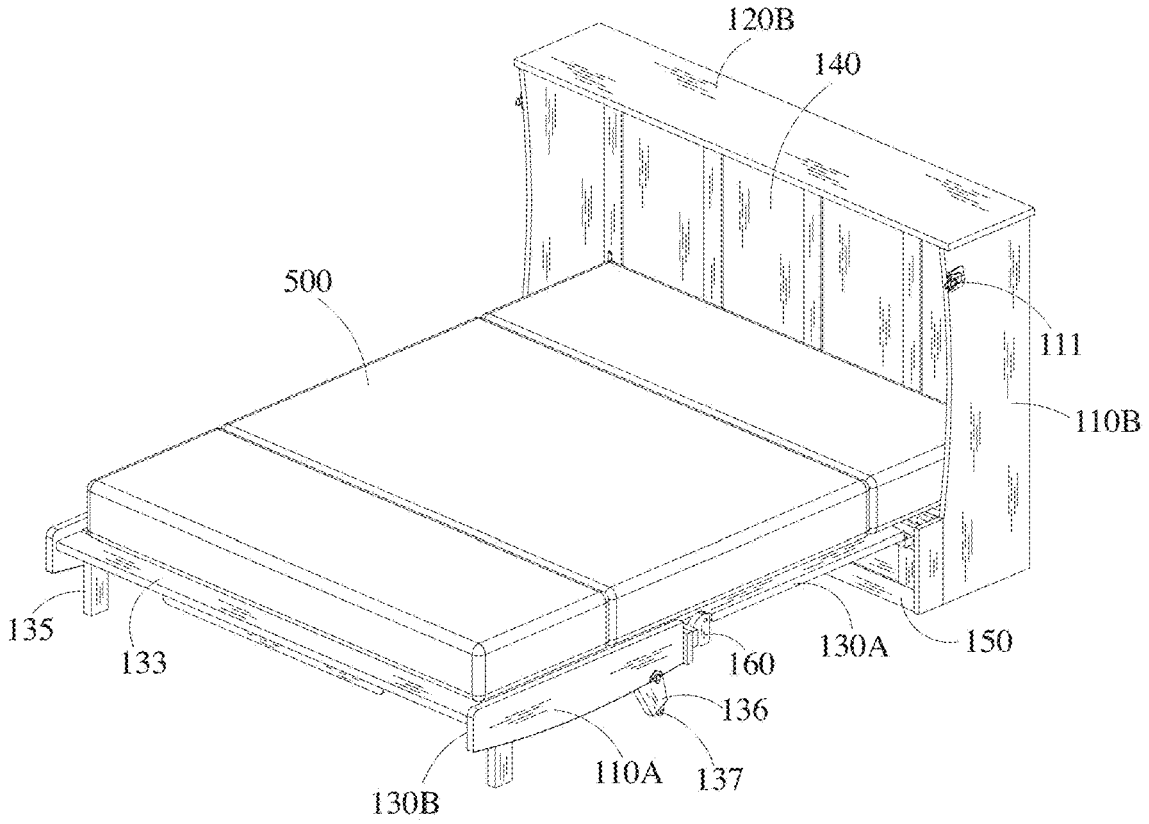

FIGS. 29 to 31 illustrate a kit including a chest configured to store a foldable bed and a mattress according to example embodiments.

Referring to FIGS. 29 to 31, the chest 100 may be included in a kit along with the mattress 500 or may be separately provided with the mattress 500 to form the kit.

In a fifth operation to unfold the chest 100, the mattress 500 may be removed from the enclosure inside the cabinet 100, and the folding slat deck 200 may be unfolded so that the holding slat deck 200 is substantially in the same horizontal position as the outer front panel 130A and the inner front panel 130B, thus, forming the sleeping platform for the mattress 500. Thereafter, the mattress 500 may be unfolded and placed on the sleeping platform. For example, as shown in FIG. 31, in an effort to avoid placing a crease of the mattress in a middle of a user's body, the mattress may include two separate folds located on an upper third and a lower third of the mattress 500 such that the mattress 500 is unfolded by unfolding the lower third and the upper third of the mattress 500.

Figure 32:
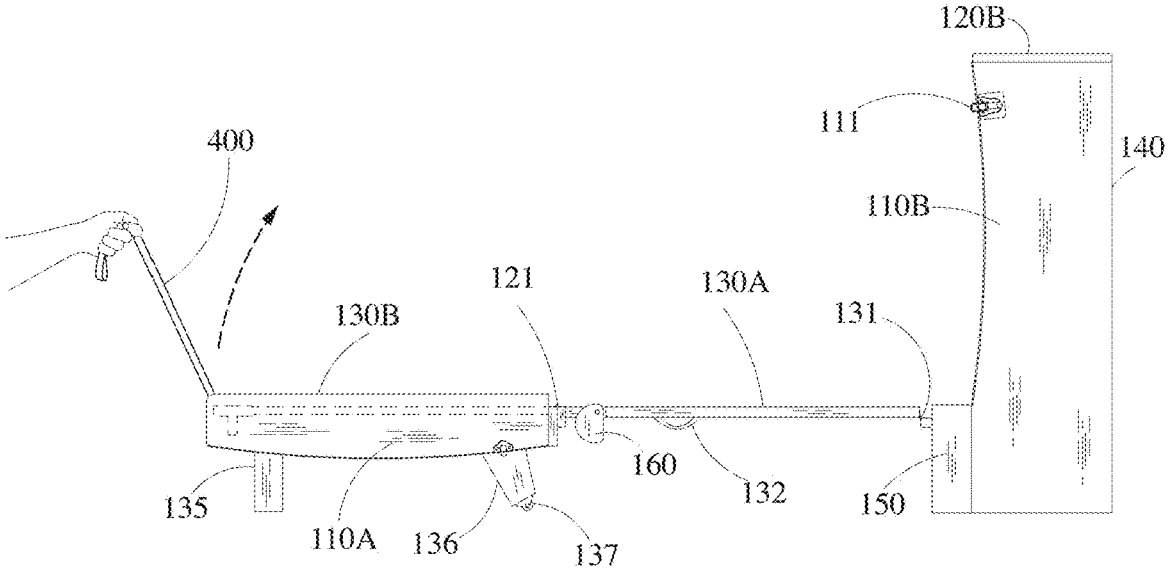
FIGS. 32 to 34 illustrate a method of folding a chest from an open or unfolded position to a closed or folded position according to example embodiments.
Figure 33:
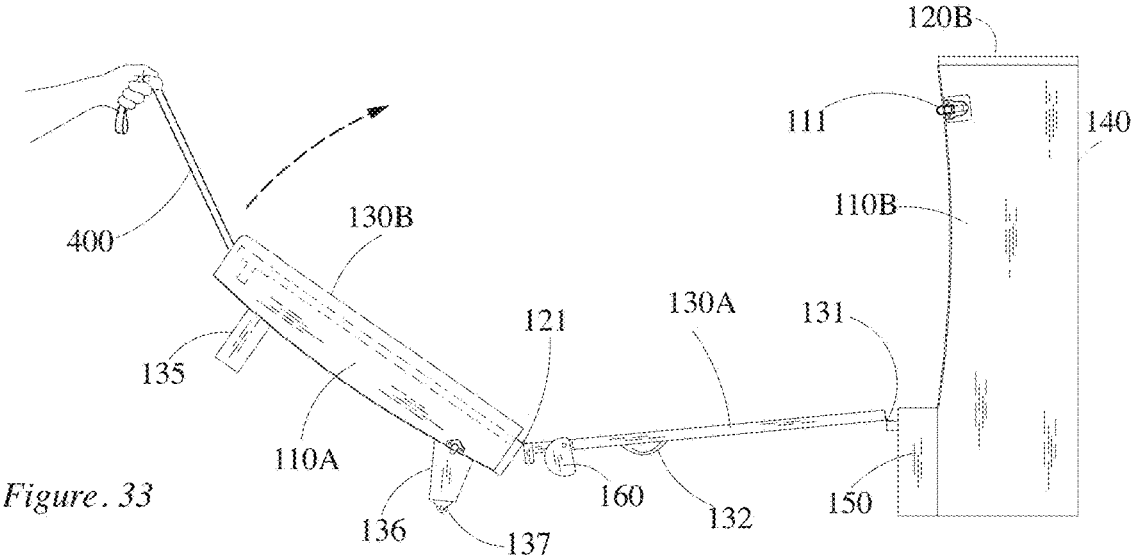
Figure 34:
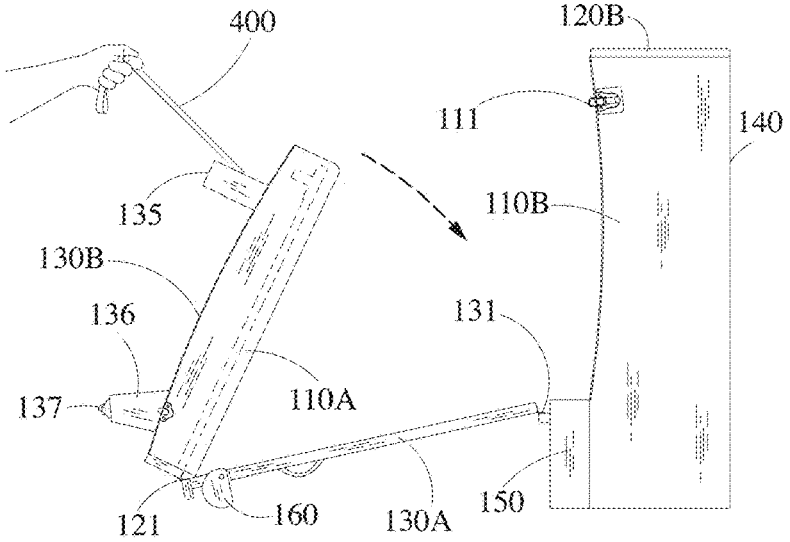
Figure 35:
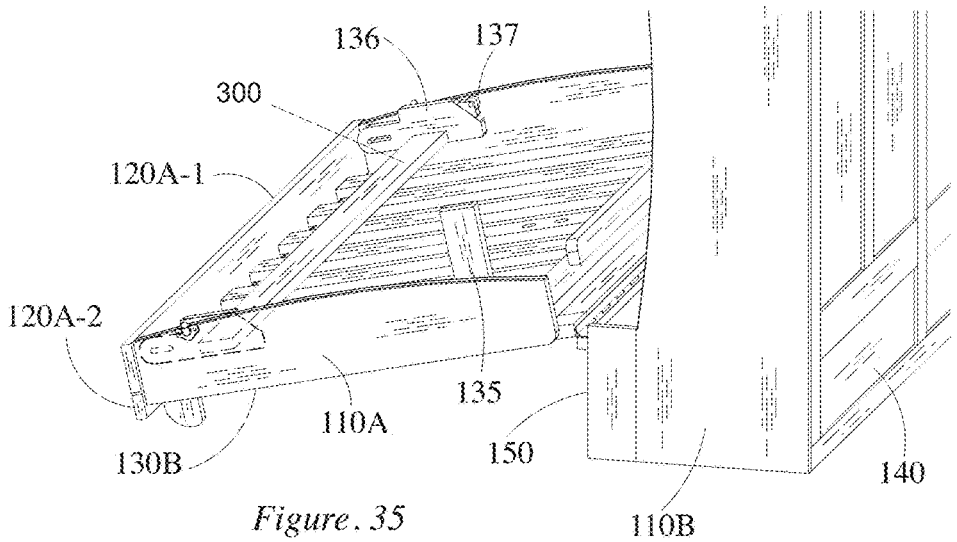
FIGS. 35 to 42 illustrate a chest configured to store a foldable bed according to some other example embodiments.
Figure 36:
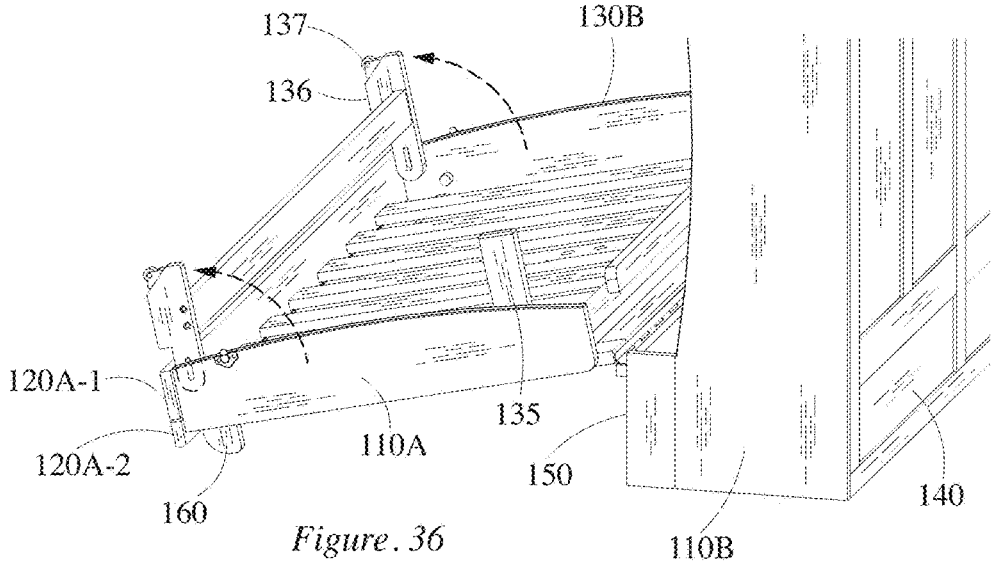
Figure 37:
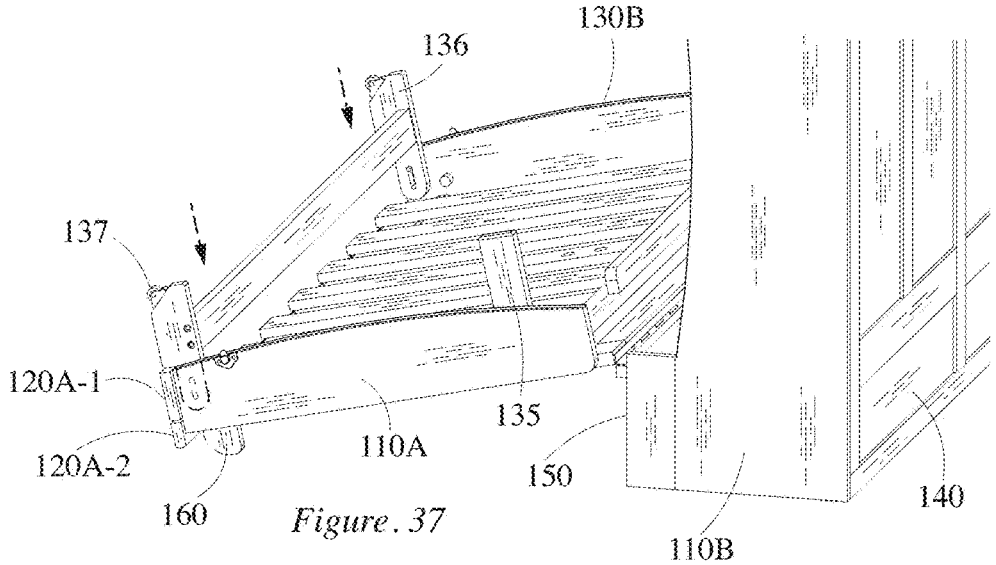
Figure 38:
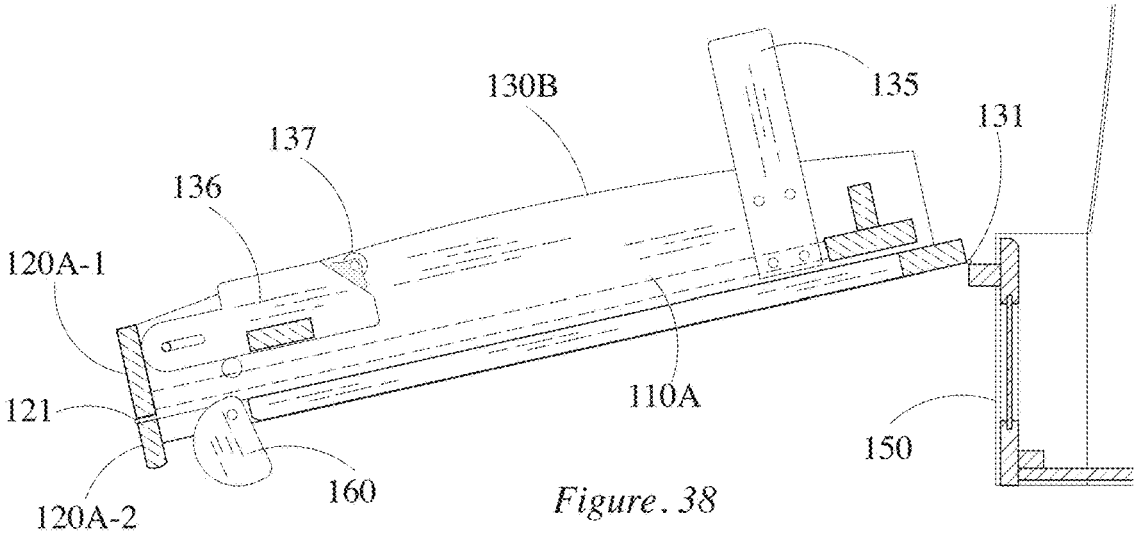
Figure 39:
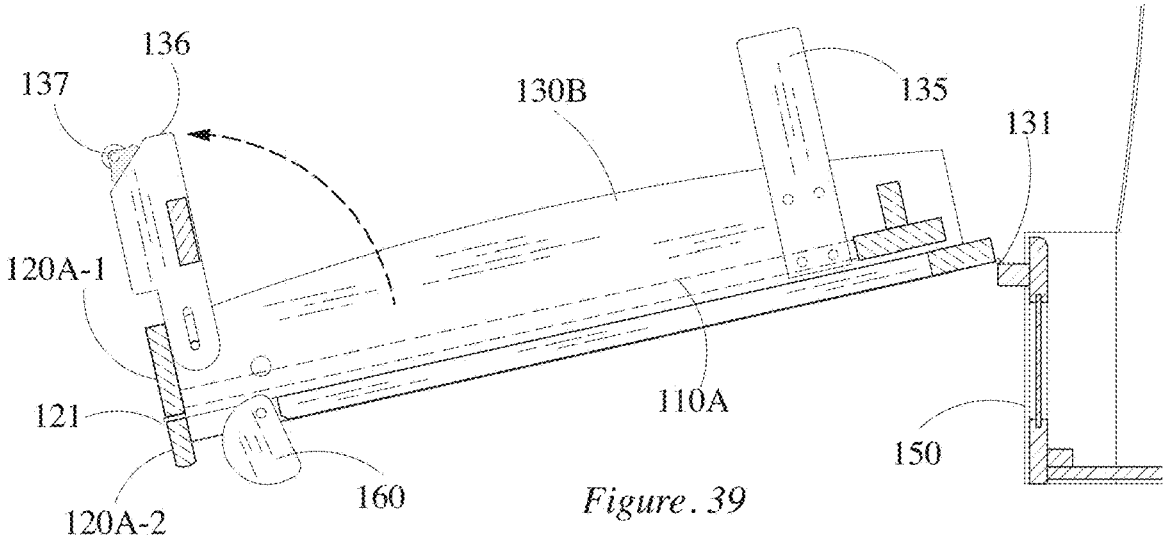
Figure 40:
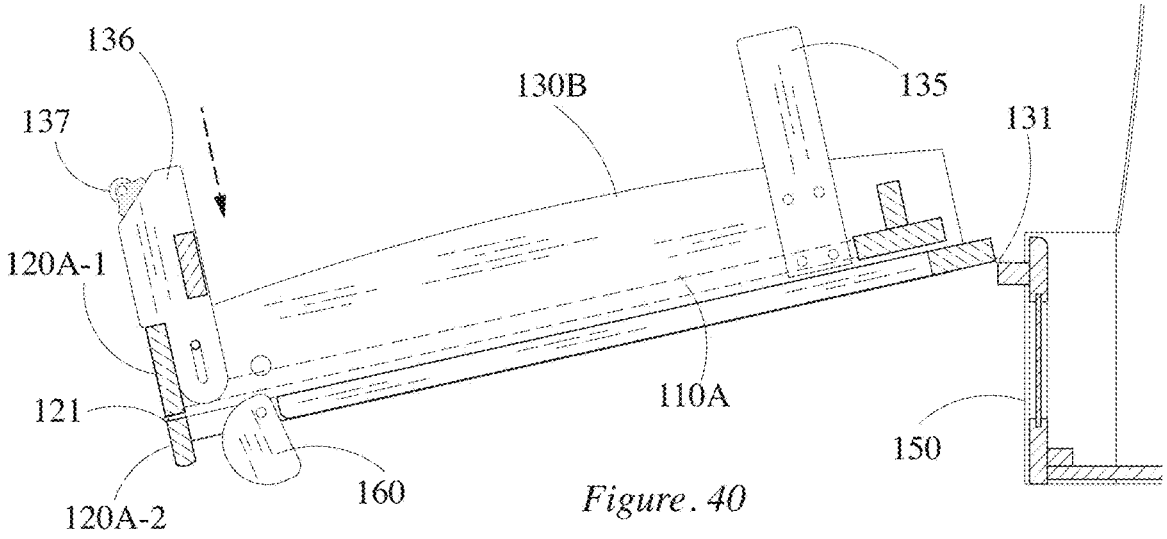
Figure 41:
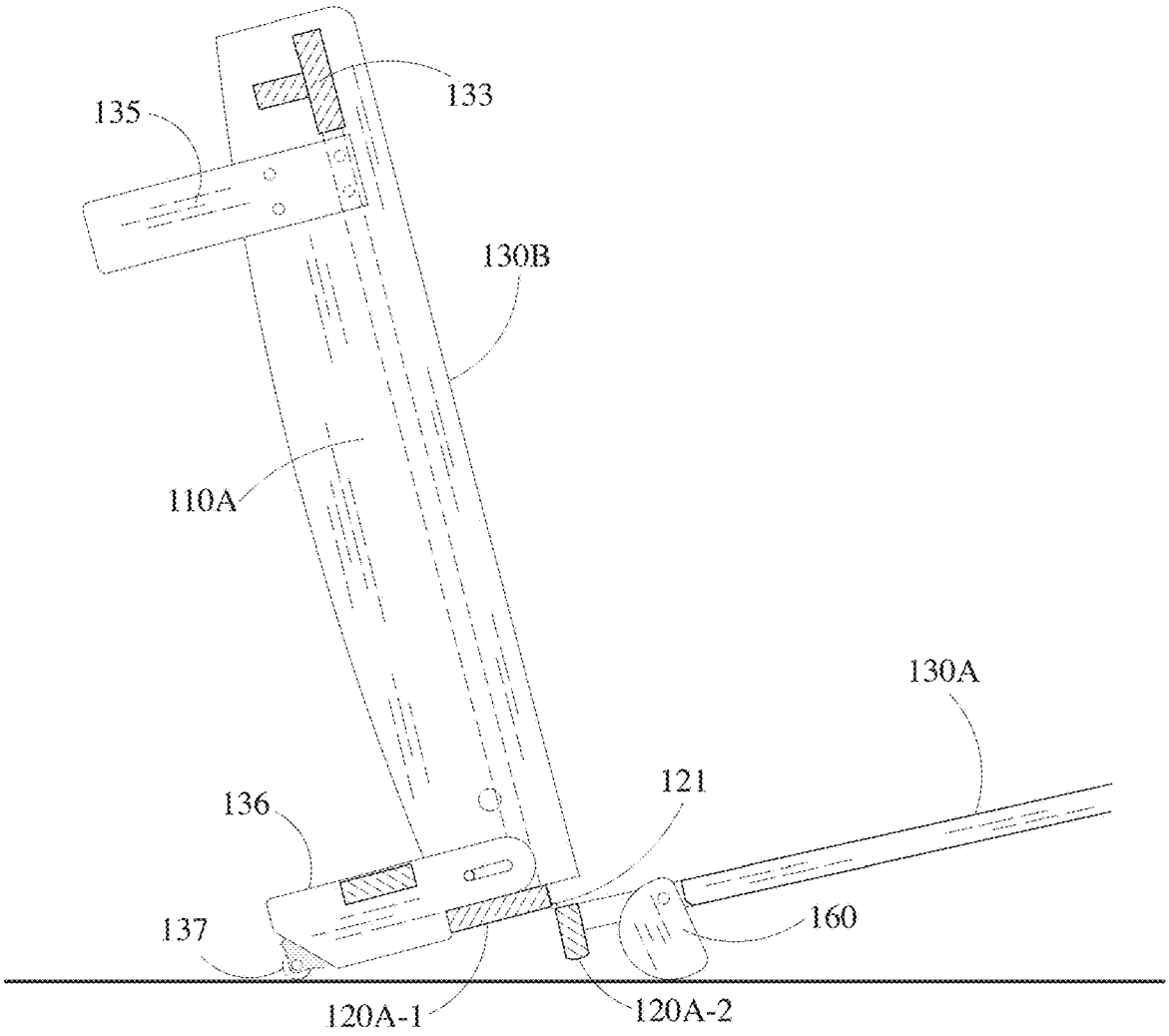
Figure 42:
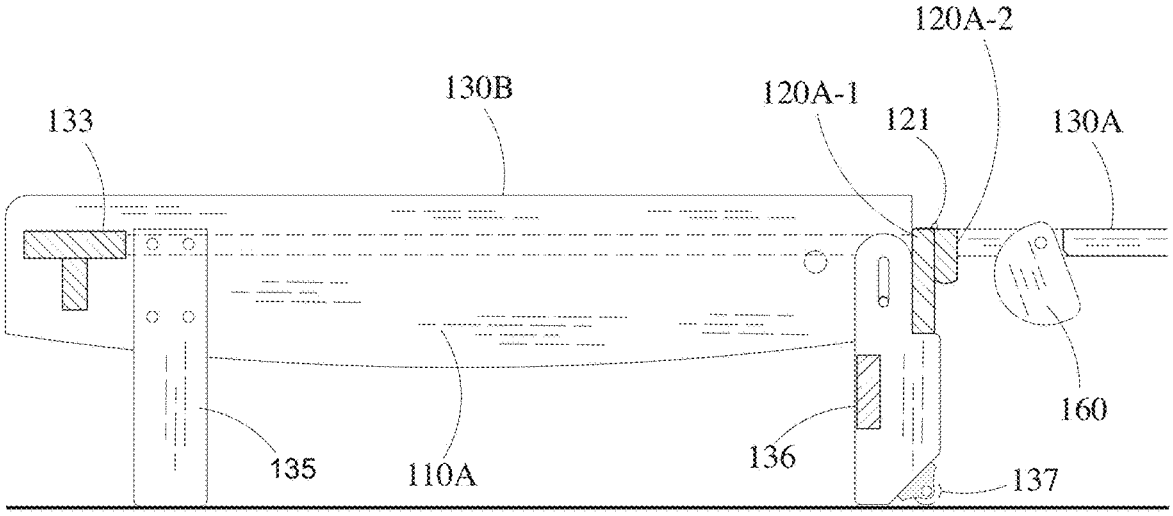
Figure 43:
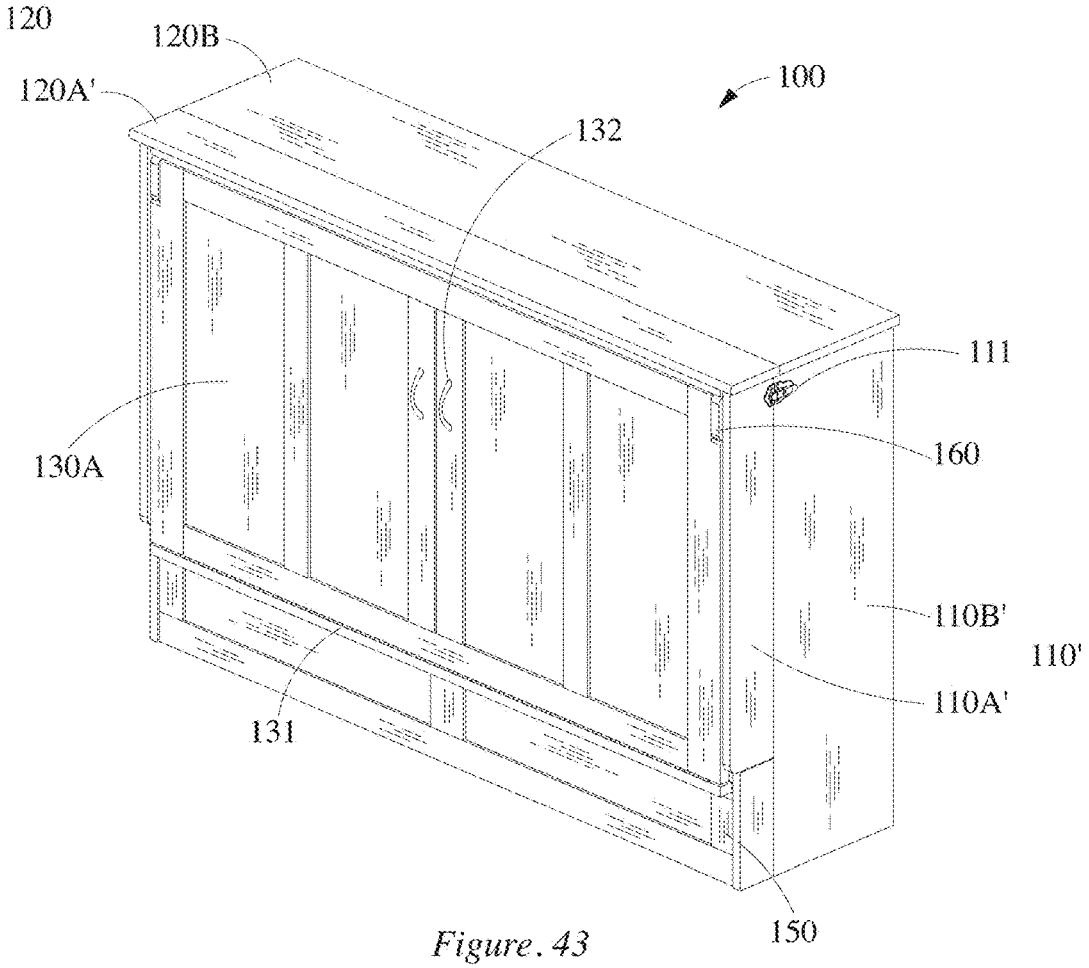
FIGS. 43 to 55 illustrate a chest configured to store a foldable bed according to some other example embodiments.
Figure 44:
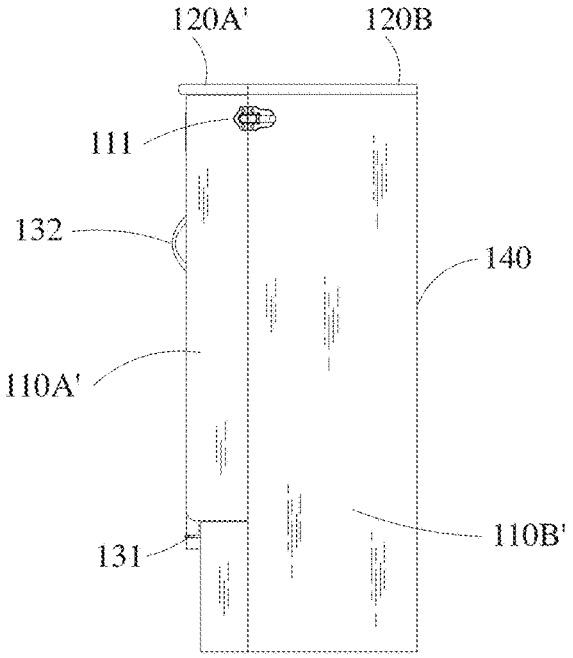
Figure 45:
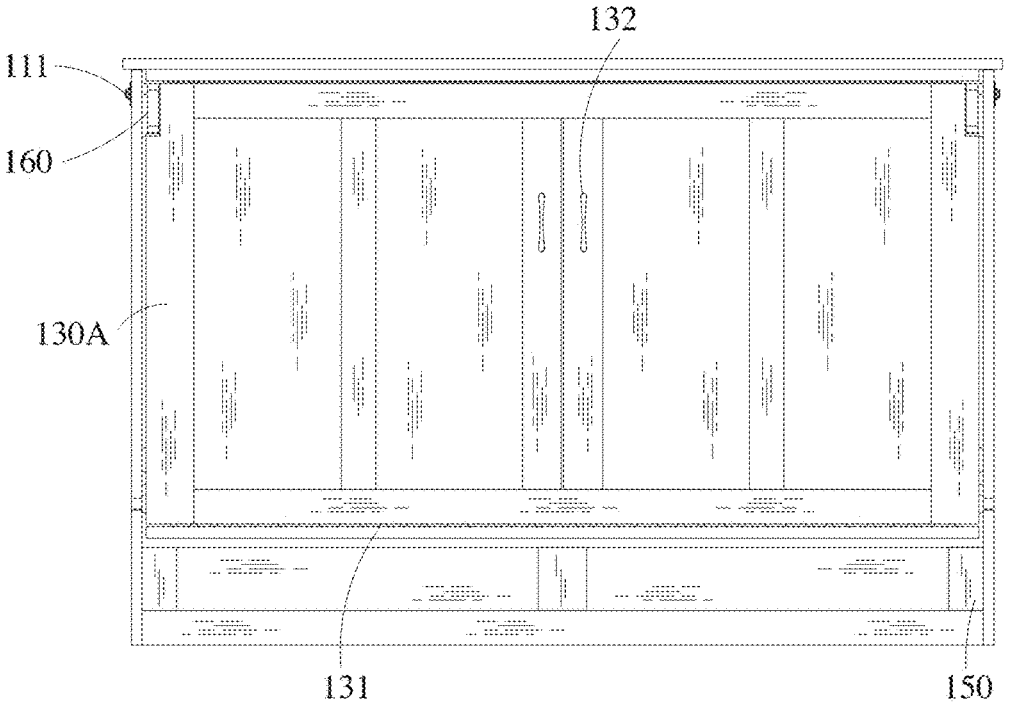
Figure 46:
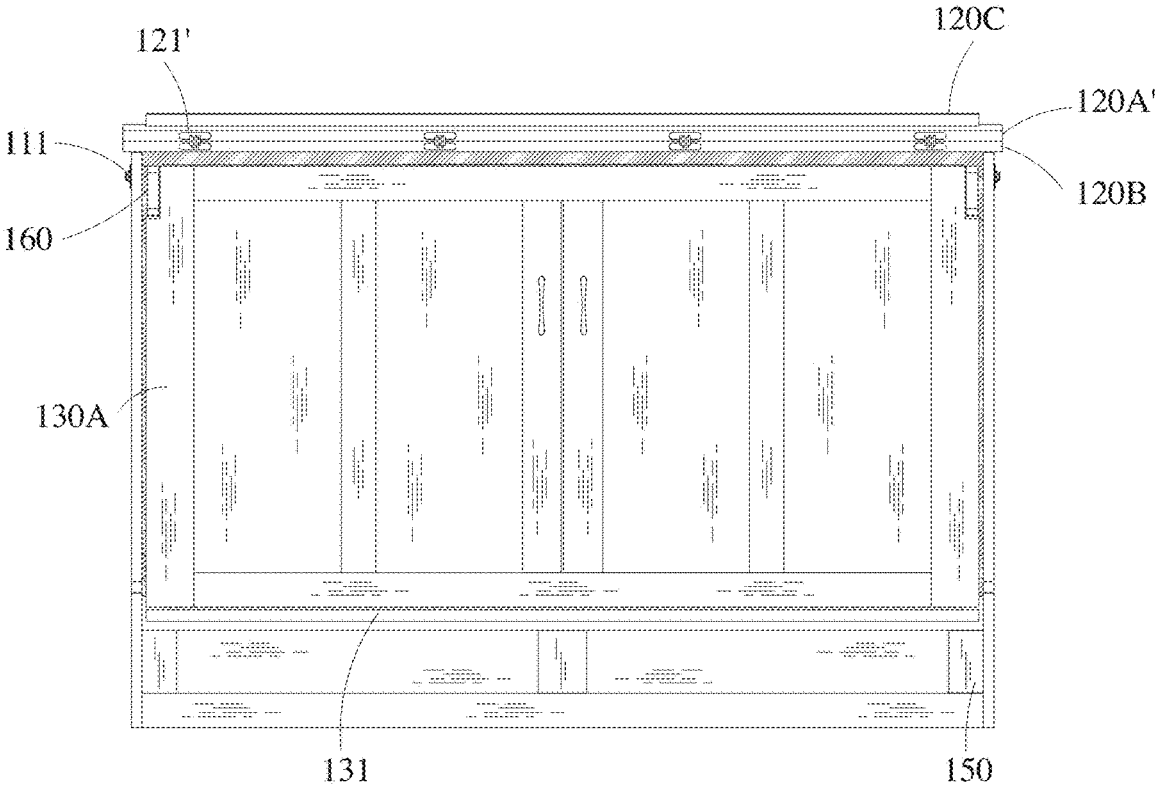

FIGS. 32 to 34 illustrate a method of folding a chest from an open or unfolded position to a closed or folded position according to example embodiments.

Referring to FIGS. 32 to 34, to fold the chest 100, a user may perform a reversal of the process discussed above with regards to unfolding the chest 100. For example, in a first operation associated with folding the chest 100, the user may provide an upward force p lifting the full weight w2 of the inner front panel 130B.

Thereafter, the upwards motion of the inner front panel 130B and the lowering of the outer front panel 130A, causes the rollers 137 to move away from the chest 100 (e.g., towards the user) such that the center of the weight w2 moves closer to the fulcrum (e.g., the rollers 137), and, thus, the rollers 137 support more of the weight w2 of the inner front panel 130B. The magnitude of the input force p provided by the user decreases as the user continues to fold the inner front panel 130B until a transition point is reached at a mid-angle, where the input force p will diminish to zero, and the lever will be a perfect balance between the center of the weight w2 of the inner front panel 130B and the center of the weight w1 of the outer front panel 130A acting through the first hinge 121.

Beyond this transition point the user will not need to provide any further forward force, only a light reverse force to keep the motion of the inner front panel 130B under control until the lower support is back at rest similar to that of FIGS. 13 and 14. As the outer front panel 130A moves back to a vertical position as the chest 100 is closed, the pivoting guards 160 may remain extended due to the offset of their pivot point. Thus, the user may manually apply a force to the pivoting guards 160 to urge the pivoting guards 160 to retract back into the enclosure.

FIGS. 35 to 42 illustrate a chest configured to store a foldable bed according to some other example embodiments.

Referring to FIGS. 35 to 42, rather than the rear legs 136 angled towards the rear of the inner front panel 130B to allow sufficient clearance between the rear legs 136 and the top panel 120 when the inner front panel 130B is folded into the chest 100, in some example embodiments, the chest 100 may further include the rear folding leg assembly 300. The rear folding leg assembly 300 may include the rear legs 136 having the rollers 137 extending from a bottom thereof.

The rear folding leg assembly 300 may be connected to the first portion 120A-1 of the first sub-top panel 120A. For example, a first one of the first portion 120A-1 and the rear folding leg assembly 300 may include a slot therein and the second one of the first portion 120A-1 and the rear folding leg assembly 300 may include a protrusion thereon, where the rear folding leg assembly 300 is configured to pivot from a closed position to an open position by rotating of the slot about the protrusion, and subsequently secured into place by applying a force to slide the folding leg assembly towards the upper front panel 120A.

The rear folding leg assembly 300 may allow the rear legs 136 to be folded so that there is sufficient clearance between the rear legs 136 and the top panel 120 when the inner front panel 130B is folded into the chest 100 while placing the rear leg 136 directly under the first hinge 121 to increase a stability of the sleeping platform by removing a lever action urging the inner front panel 130B to fold.

FIGS. 43 to 55 illustrate a chest configured to store a foldable bed according to some other example embodiments.

Referring to FIGS. 43 to 55, as discussed above, to allow sufficient clearance between the rear legs 136 and the top panel 120 when the inner front panel 130B is folded into the chest 100, the rear legs 136 may be offset from the rear of the inner front panel 130B and angled towards the rear of the inner front panel 130B as discussed above with reference to FIGS. 1-34, or the chest 100 may include a rear folding leg assembly 300 as discussed above with reference to FIGS. 35 to 42.

However, while such offsetting of the rear legs 136 allows the rear legs 136 to fit within the enclosure when the chest 100 is folded into the closed position, such an arrangement may reduce the stability of the chest 100 since the wheels 137 of the rear legs 136 are offset from the hinge 121 that connects the inner front panel 130B and the outer front panel 130A via the first portion 120A-1 and the second portion 120A-2 of the first sub-top panel 120A, which are attached to the inner front panel 130B and the outer front panel 130A, respectively. This offset may result in a situation where the outer front panel 130A and the inner front panel 130B jack-knife as wheels 137 roll in a direction away from chest 100, which may cause a user harm and/or damage the chest 100. Further, the use of the rear folding leg assembly 300 increases the costs and complexity associated with the manufacturing of the chest 100 and also requires additional steps to be performed by the user in opening, closing and securing the rear leg assembly 300 during use of the chest 100.

As such, in one or more example embodiments, as illustrated in FIGS. 43 to 55, the top panel may include a foldable first sub-top panel 120A', the second sub-top panel 120B and a trim 120C. Further, the chest 100 may include modified side panels 110' where the modified side panels 110' may be straight rather than curved and include a first side panel 110A' and a second side panel 110B.

Figure 47:
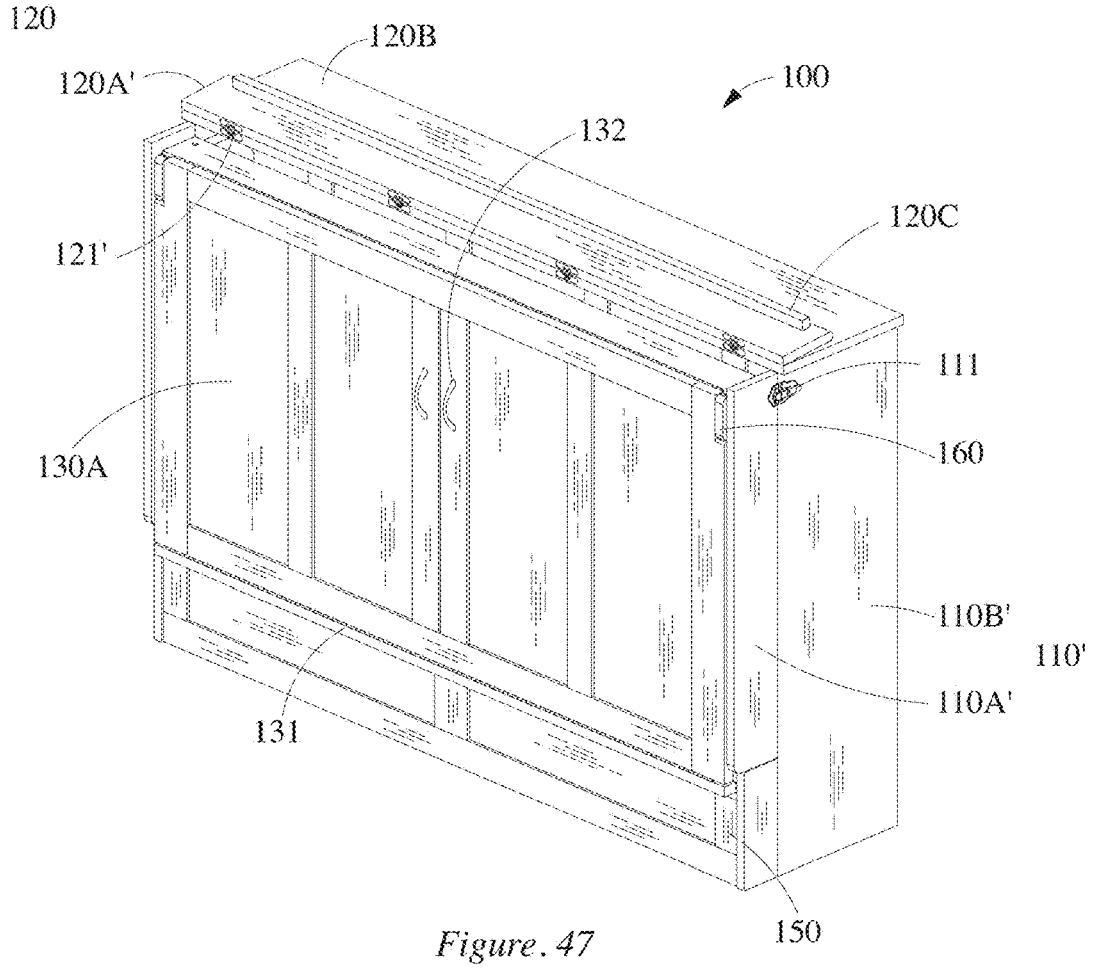
Figure 48:
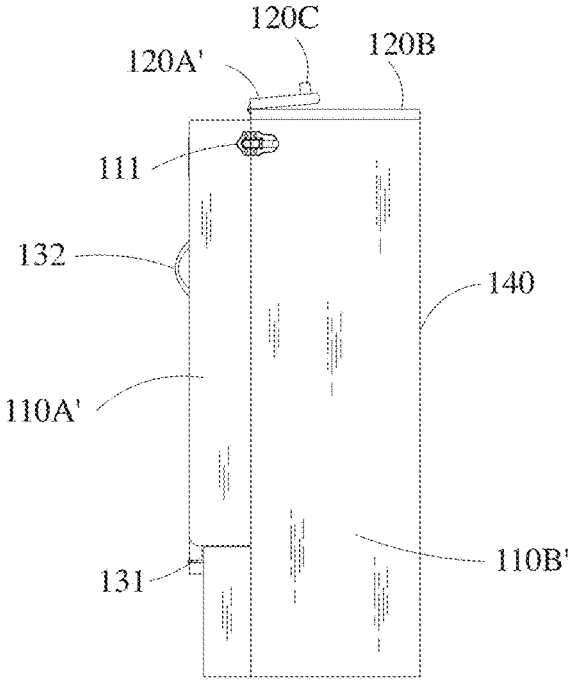

Unlike the first sub-top panel 120 that is connected to the front panel 130B and moves together therewith, the foldable first sub-top panel 120' may be connected to the second sub-top panel 120B via a hinge 121' rather than connected to the front panel 130B. While FIG. 47 illustrates that the hinge 121' between the first and second sub-top panels 120A', 120B aligned in the width direction with the break between first and second side panels 110A', 110B', example embodiments are not limited thereto. For example, the second sub-top panel 120B may be shorter in the width direction than the second side panel 110B' so that a portion of the first sub-top panel 120A' rests on the second side panel 110B' when unfolded to provide support to the first sub-top panel 120A' when the first side panels 110A' are displaced when chest is open.

Further, the trim 120C may fill a gap above the front panel 130 when the chest 100 is closed, and the foldable first sub-top panel 120' along with the trim 120C may fold with respect to the second sub-top panel 120B when the chest is opened to provide sufficient clearance for the rear legs 136.

Figure 49:
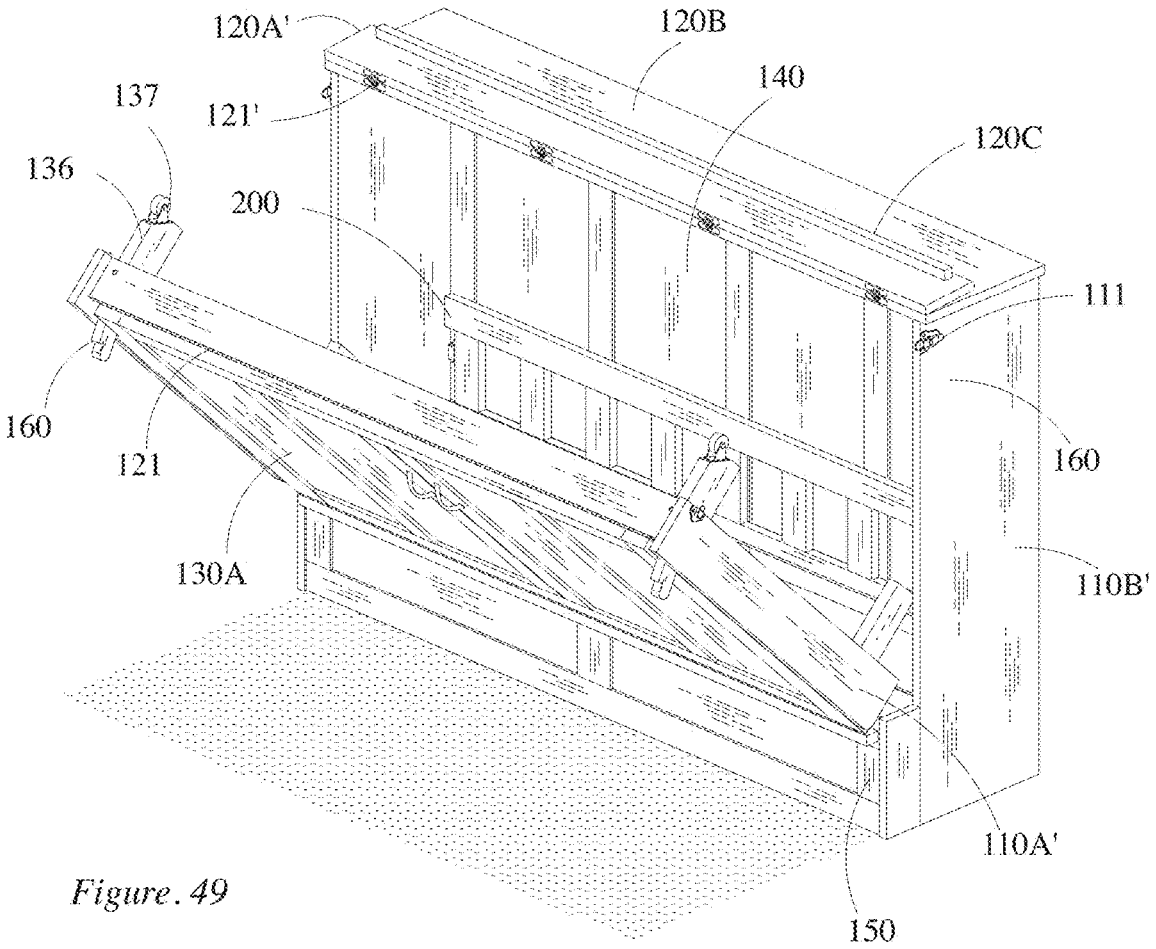
Figure 50:
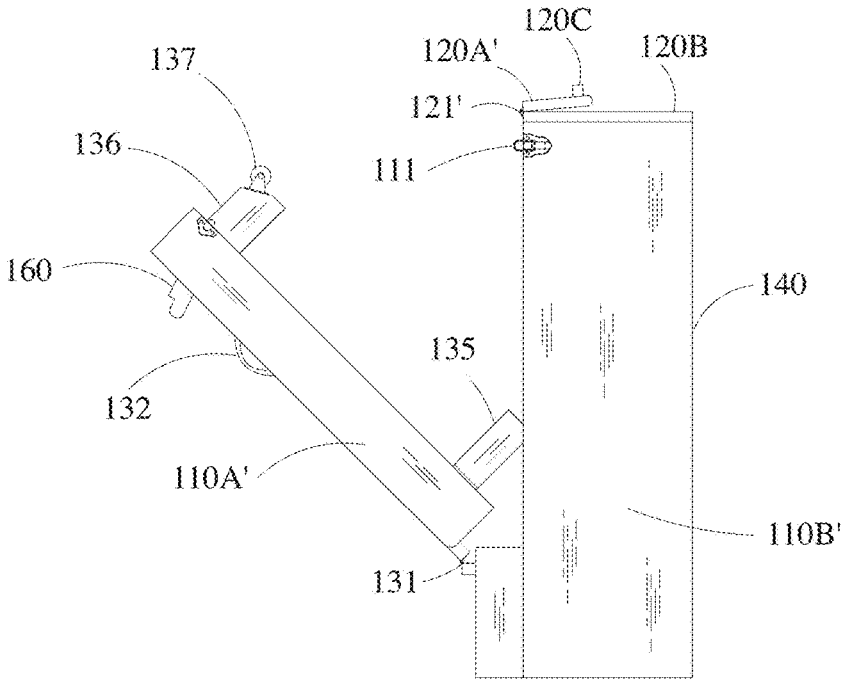
Figure 51:
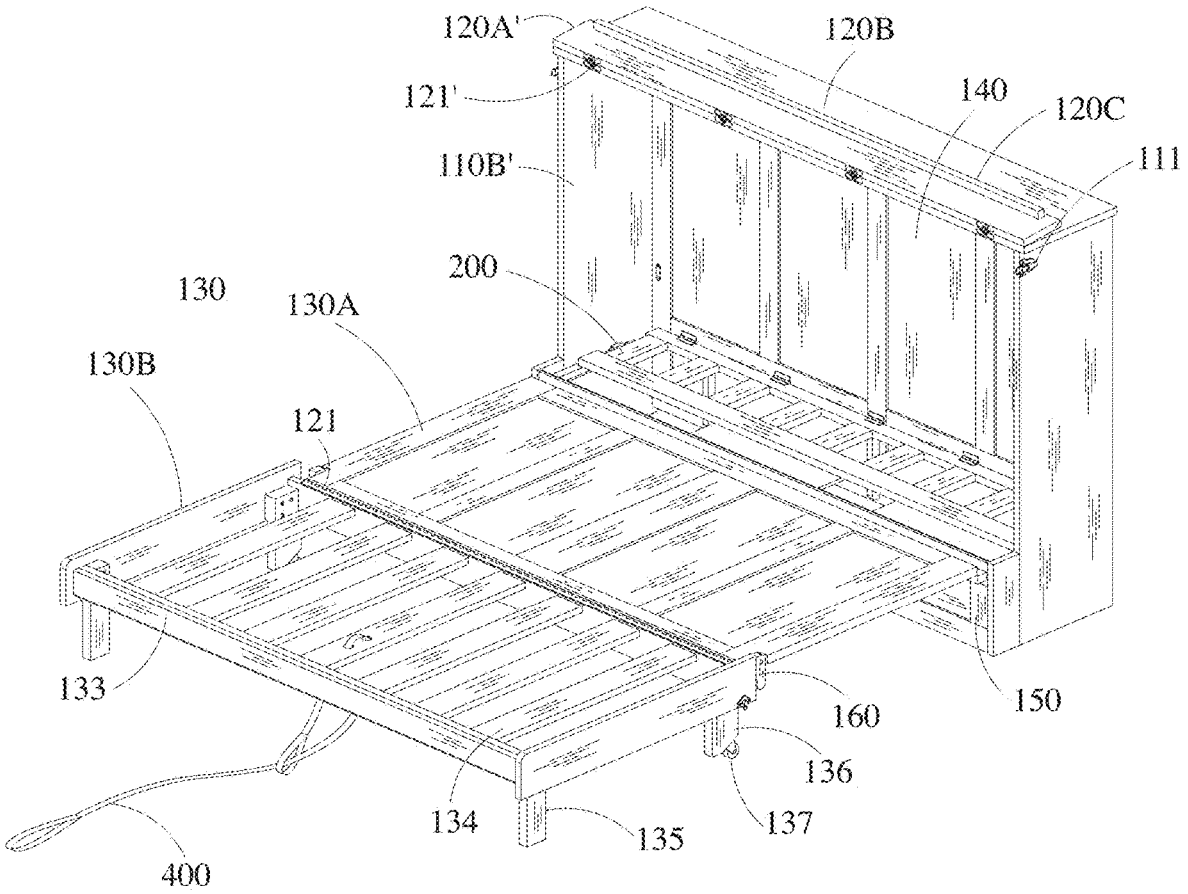
Figure 52:
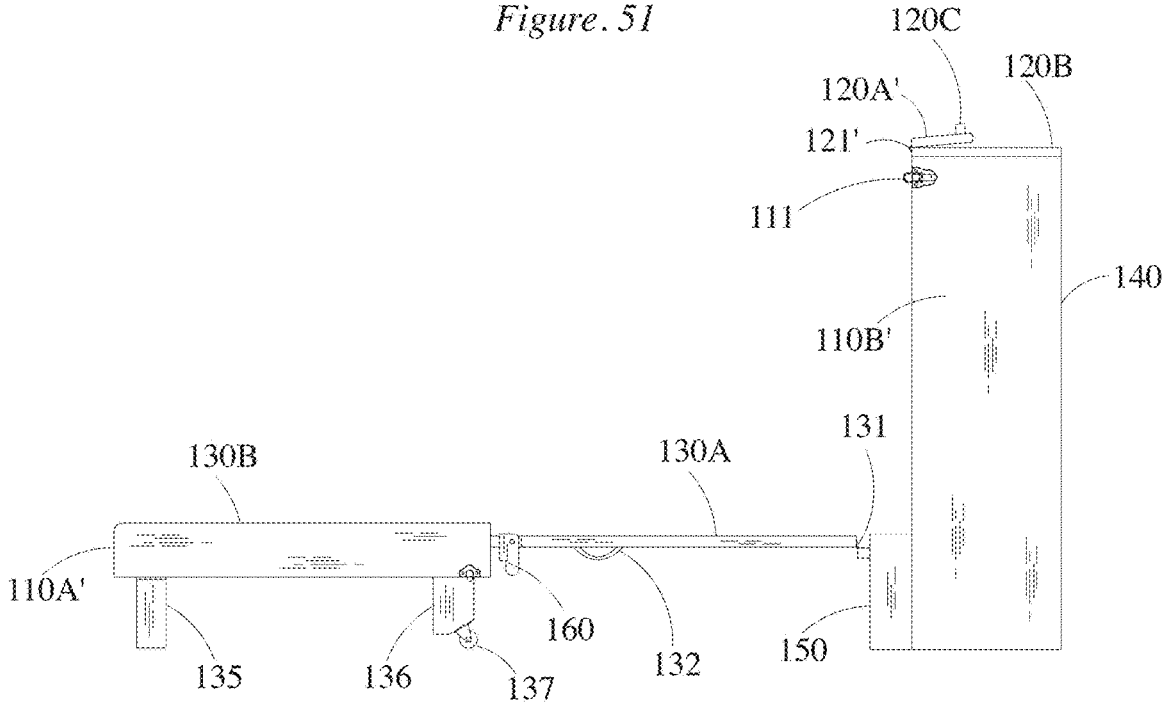
Figure 53:
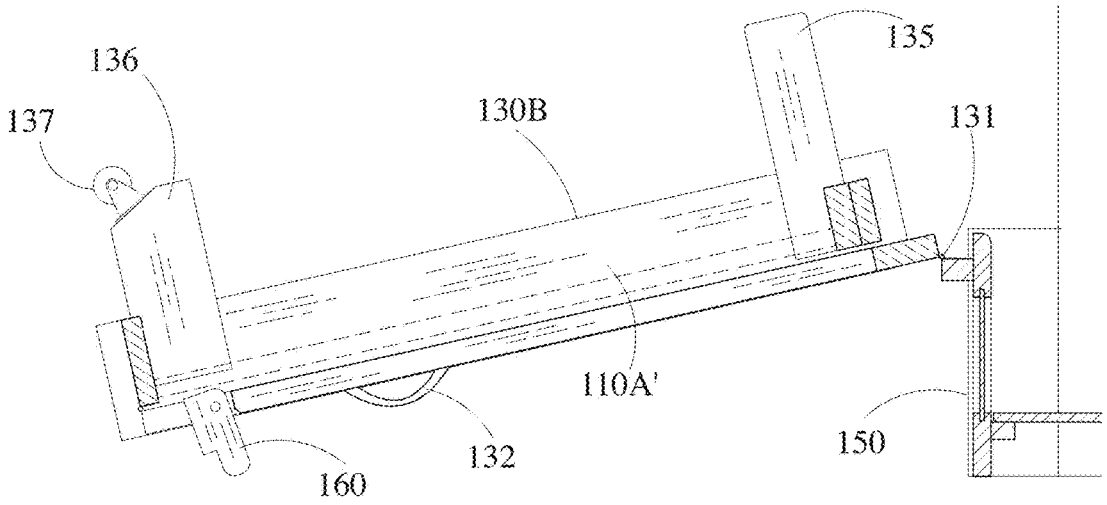
Figure 54:
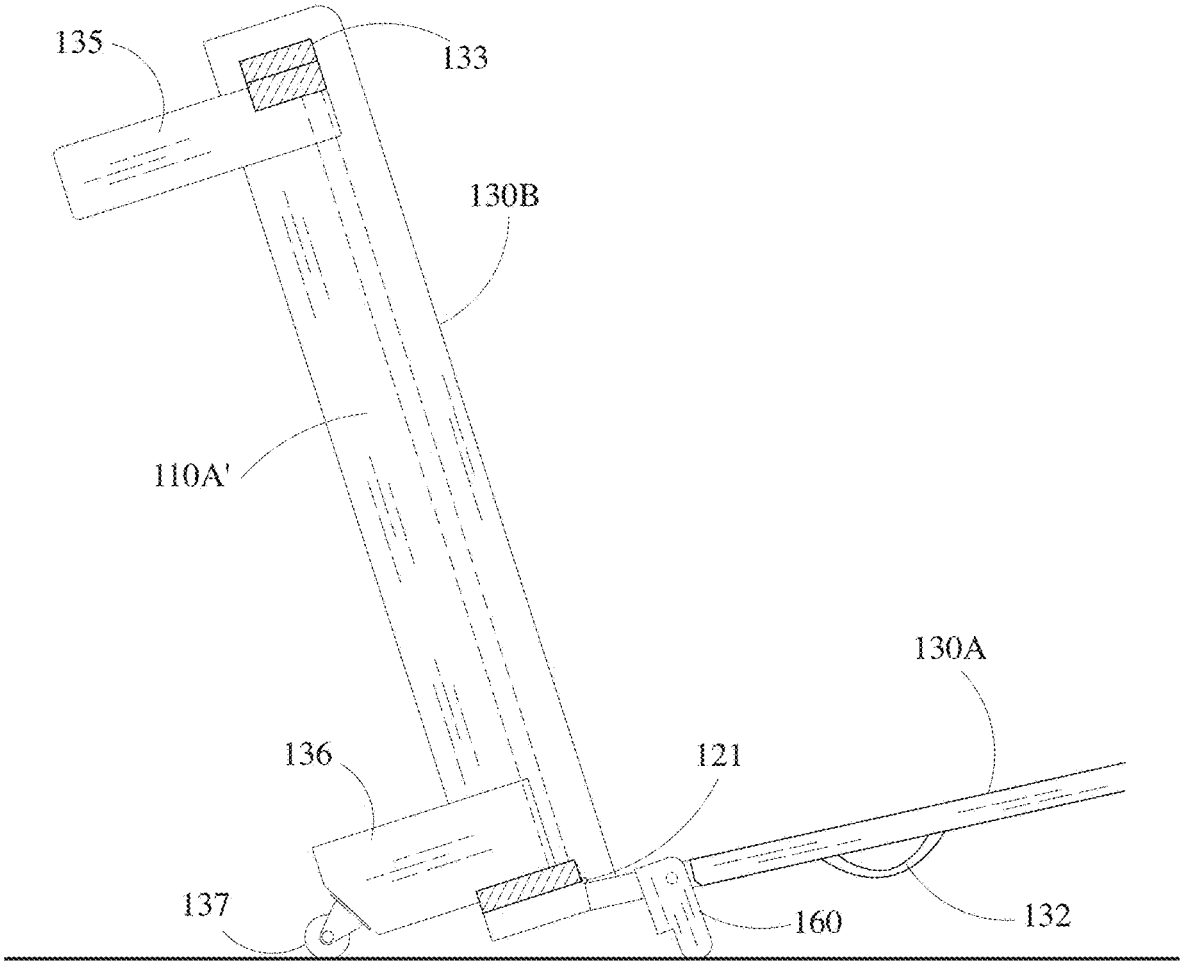
Figure 55:
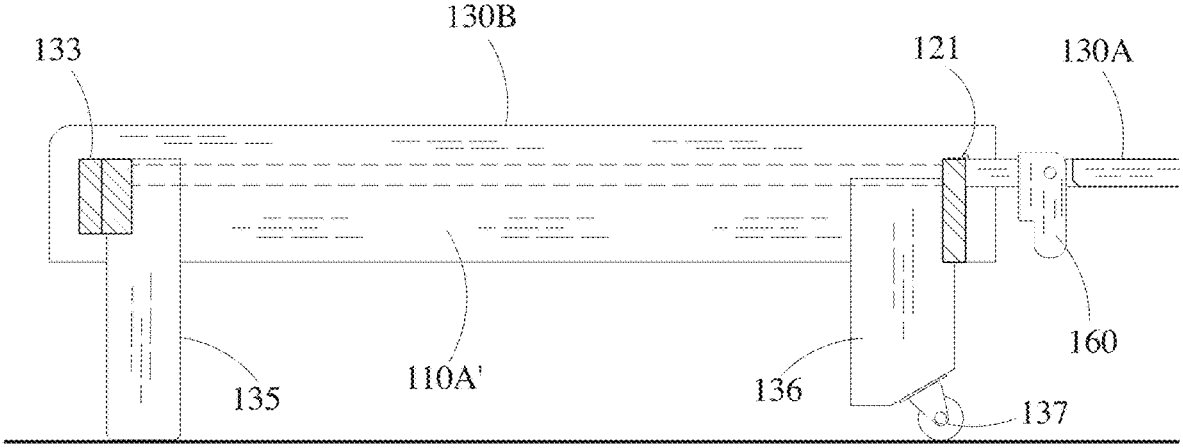

As such, as illustrated in FIGS. 49 and 50, the rear legs 136 may clear the top panel 120 when the inner front panel 130B is folded into and out of the chest 100 while allowing the rear leg 136 to be placed directly under the first hinge 121, as illustrated in FIGS. 52 to 55, without the costs and complexity associated with the use of the rear folding leg assembly 300.

Further, by having the top panel 120' be foldable, similar benefits are provided as where the first sub-top panel 120A folds downwards along with the first side panels 110A, namely that the user is less confined when laying on the sleeping platform as compared a chest where the side and top panels remain stationary when the front panel is opened.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A chest configured to transition between an open position and a closed position with an intermediate position therebetween, the chest comprising:

a front panel, side panels and a top panel, the front panel including a first portion and a second portion, the side panels including first sub-side panels and second sub-side panels, the top panel including a first sub-top panel and a second sub-top panel hingably connected to the first sub-top panel, the first portion of the front panel being hingably connected to a base of the chest, and the second portion of the front panel hingably connected to the first portion of the front panel and fixed to the first sub-side panels, wherein the second portion of the front panel is stored within an enclosure formed by at least the first portion of the front panel, the side panels and the top panel when the chest is in the closed position, the first portion and the second portion of the front panel form at least a portion of a sleeping platform when the chest is in the open position, the first sub-top panel is foldable onto the second sub-top panel to reduce a width the top panel extends at least during the transition between the open position and the closed position, and the first sub-side panels each include legs connected thereto, the legs including front legs and rear legs, the rear legs having a gliding mechanism attached thereto, the gliding mechanism configured glide, as the chest transitions from the intermediate position to the open position, along a ground while the rear legs move from a first position to a second position closer to the base of the chest than the first position.

2. The chest of claim 1, further comprising:

blocks configured to maintain a gap between the first portion of the front panel and the ground during at least a portion of a transition of the chest from the closed position to the open position.

3. The chest of claim 2, wherein the blocks are pivotably attached to the chest, the blocks configured to pivot outwards beyond an outer surface of the first portion of the front panel during the transition of the chest from the closed position to the open position.

4. The chest of claim 3, wherein the blocks are pivotably attached to the first portion of the front panel such that the blocks are configured to support at least the first portion of the front panel during a period of the transition of the chest from the closed position to the open position.

5. The chest of claim 1, wherein the gliding mechanism comprises:

rollers attached to a bottom surface of the rear legs, the rollers configured to allow the rear legs to move in a first direction when a connection point between the first portion and the second portion moves in a second direction, the second direction being substantially perpendicular to the first direction.

6. The chest of claim 1, wherein the second portion of the front panel is configured to form a lever to assist in transitioning the chest between the closed position and the open position.

7. The chest of claim 6, wherein the rear legs attached to the first sub-side panels act as a fulcrum of the lever.

8. The chest of claim 7, wherein the rear legs are positioned substantially at respective corners of the second portion of the front panel.

9. The chest of claim 8, wherein the rear legs extend perpendicular with respect to the second portion of the front panel to form a 90 degree angle therebetween, and the first sub-top panel is foldable onto the second sub-top panel to reduce the width the top panel extends such that the rear legs clear the top panel during the transition between the open position and the closed position.

10. The chest of claim 1, further comprising:

a folding deck within the enclosure, the folding deck configured to transition between an unfolded state and a folded state such that the folding deck separates the enclosure into a top portion and bottom portion when the folding deck is in the unfolded state, and combines the top portion and the bottom portion of the enclosure into a single usable space when the folding deck is in the folded state.

11. The chest of claim 10, wherein the second portion and the first portion of the front panel form a lower portion and a middle portion of the sleeping platform, respectively, when the chest is in the open position, and the folding deck forms an upper portion of the sleeping platform when the folding deck is in the unfolded state.

12. The chest of claim 11, wherein the chest is configured to, store a foldable mattress in the single usable space when the folding deck is in the folded state, and receive the foldable mattress on the sleeping platform when the chest is in the open position and the folding deck is in the unfolded state.

13. The chest of claim 12, wherein, when the chest is in the closed position, an outer surface of the first portion of the front panel is visible, and when the chest is in the open position, the sleeping platform is configured to support the foldable mattress such that the foldable mattress rests on the folding deck, an inner surface of the first portion of the front panel and the second portion of the front panel, the inner surface of the first portion of the front panel being opposite the outer surface.

14. The chest of claim 1, wherein the top panel further includes a trim attached to the first sub-top panel.

15. The chest of claim 14, wherein the first sub-side panels are configured to abut respective ones of the second sub-side panels to form the side panels when the chest is in the closed position, and the first sub-top panel is configured to selectively abut against an edge of at least the first sub-side panels when the chest is in the closed position.

16. The chest of claim 1, wherein, while the chest is transitioning from the closed position to the open position, the first sub-side panels are configured to move relative to the base of the chest while the second sub-side panels remain stationary such that, in the open position, a depth that the base of the chest above the sleeping platform extends is reduced.

17. The chest of claim 1, further comprising:

a back panel fixed to the second sub-side panels, the back panel configured as a headboard of the sleeping platform when the chest is in the open position.

18. The chest of claim 1, further comprising:

a strap attached to the second portion of the front panel, the strap configured to transfer a force exerted by a user thereon to the second portion of the front panel to unfold the second portion of the front panel from on top of the first portion of the front panel while the chest is transitioning to the open position and to fold the second portion of the front panel on top of the first portion of the front panel while the chest is transitioning to the closed position.

19. A chest configured to transition between an open position and a closed position with an intermediate position therebetween, the chest comprising:

a front panel, side panels and a top panel, the front panel including a first portion and a second portion, the side panels including first sub-side panels and second sub-side panels, the first portion of the front panel being hingably connected to a base of the chest, and the second portion of the front panel hingably connected to the first portion of the front panel and fixed to the first sub-side panels, wherein the second portion of the front panel is stored within an enclosure formed by at least the first portion of the front panel, the side panels and the top panel when the chest is in the closed position, the first portion and the second portion of the front panel form at least a portion of a sleeping platform when the chest is in the open position, and the first sub-side panels each include legs connected thereto, the legs including front legs and rear legs, the rear legs having a gliding mechanism attached thereto, the gliding mechanism configured glide, as the chest transitions from the intermediate position to the open position, along a ground while the rear legs move from a first position to a second position closer to the base of the chest than the first position.

20. A chest configured to transition between an open position and a closed position, the chest comprising:

a front panel, side panels and a top panel, the front panel including a first portion and a second portion, the side panels including first sub-side panels and second sub-side panels, the first portion of the front panel being hingably connected to a base of the chest, and the second portion of the front panel hingably connected to the first portion of the front panel and fixed to the first sub-side panels, wherein the second portion of the front panel is stored within an enclosure formed by at least the first portion of the front panel, the side panels and the top panel when the chest is in the closed position, the first portion and the second portion of the front panel form at least a portion of a sleeping platform when the chest is in the open position, and the first sub-side panels each include legs connected thereto, the legs including front legs and rear legs, the rear legs having rollers attached thereto.

* * * * *